US006884766B2

(12) United States Patent
DeClercq et al.

(10) Patent No.: US 6,884,766 B2
(45) Date of Patent: Apr. 26, 2005

(54) MULTI-PHASE FABRIC CARE COMPOSITION FOR DELIVERING MULTIPLE FABRIC CARE BENEFITS

(75) Inventors: Marc Johan DeClercq, Strombeek-Bever (BE); Hugo Jean Marie DeMeyere, Merchtem (BE); Serge Gabriel Pierre Roger Cauwberghs, Sint-Niklaas (BE); Kristine Janssens, Herent (BE); Franciscus Joseph Madeleine DeBlock, Merchtem (BE); Johan Maurice Theo DePootere, Oost Vlaanderen (BE); Kimiko Fukushima, Osaka (JP); Akiko Taneko, Kobe (JP)

(73) Assignee: The Procter & Gamble Company, Cincinnati, OH (US)

( * ) Notice: Subject to any disclaimer, the term of this patent is extended or adjusted under 35 U.S.C. 154(b) by 403 days.

(21) Appl. No.: 09/884,534

(22) Filed: Jun. 19, 2001

(65) Prior Publication Data

US 2002/0128170 A1 Sep. 12, 2002

Related U.S. Application Data

(60) Provisional application No. 60/212,565, filed on Jun. 20, 2000, provisional application No. 60/263,973, filed on Jan. 24, 2001, and provisional application No. 60/285,314, filed on Apr. 20, 2001.

(51) Int. Cl.[7] ..... C11D 1/62; C11D 1/66; C11D 7/32; C11D 7/26

(52) U.S. Cl. ..... 510/322; 510/321; 510/417; 510/438; 510/504; 510/522

(58) Field of Search ..... 510/281, 321, 510/322, 417, 438, 323, 324, 504, 521, 522

(56) References Cited

U.S. PATENT DOCUMENTS 3,718,609 A 2/1973 Weimer (Continued)

FOREIGN PATENT DOCUMENTS

| | | |
|---|---|---|
| DE | DT 2 220 540 | 11/1973 |
| EP | 0 344 847 A2 | 12/1989 |
| EP | 0 393 772 A2 | 10/1990 |

(Continued)

*Primary Examiner*—Gregory R. Del Cotto
(74) *Attorney, Agent, or Firm*—Jason J. Camp; Mark A. Charles; David V. Upite

(57) ABSTRACT

A liquid rinse-added fabric care composition that is characterized by at least two visually distinct phases when the composition is at rest and wherein at least one of the phases contains a fabric care agent is provided. The composition forms a temporary mixture when shaken that allows a consumer to dose a representative sample of the composition and spontaneously re-forms at least two visually distinct phases when allowed to remain at rest. The fabric care agents present in one or more phases of the composition may include fabric softener actives, color care agents, perfumes, antibacterial agents, malodor control agents, ultraviolet protection agents, anti-abrasion, anti-wear & fabric integrity agents, wrinkle control agents, and mixtures thereof. The composition should also contain less than about 5%, preferably less than about 3%, and even more preferably less than about 1% by weight of detergent actives. The composition optionally may contain an electrolyte, phase stabilizer, a phase separation inducing polymer and/or a solvent. Methods for delivering one or more fabric care benefits to a fabric during a laundering operation using the compositions are also disclosed. Methods for conveying information to a consumer concerning a multi-phase liquid rinse-added fabric care composition are also provided. An article of manufacture comprising a liquid rinse-added fabric care composition that has at least two visually distinct phases and a container that enables a consumer to view the visually distinct phases that are present in the composition is also described. Alternatively, the container may comprise a double walled cap and an insert for removing excess composition that may adhere to the cap.

31 Claims, 2 Drawing Sheets

U.S. PATENT DOCUMENTS

| | | | | |
|---|---|---|---|---|
| 4,348,292 | A | 9/1982 | Ginn | |
| 4,438,095 | A | 3/1984 | Grollier et al. | |
| 4,530,781 | A | 7/1985 | Gipp | |
| 4,634,544 | A | 1/1987 | Weber et al. | |
| 5,468,496 | A | 11/1995 | Touzan et al. | |
| 5,656,585 | A | 8/1997 | Grandmaire et al. | |
| 6,180,587 | B1 | 1/2001 | Fuller et al. | |
| 6,440,924 | B1 | 8/2002 | Jeschke et al. | |
| 6,521,581 | B1 * | 2/2003 | Hsu et al. | 510/297 |

FOREIGN PATENT DOCUMENTS

| | | |
|---|---|---|
| EP | 0 723 005 A1 | 7/1996 |
| EP | 0 462 806 B1 | 1/1997 |
| EP | 1 005 849 B1 | 9/2001 |
| FR | 2101710 | 3/1972 |
| GB | 1133870 | 11/1968 |
| GB | 1152972 | 5/1969 |
| GB | 1 247 189 | 9/1971 |
| GB | 2 173 508 A | 4/1986 |
| JP | 60-243199 | 12/1985 |
| JP | 61-296099 A | 12/1986 |
| JP | 62-263297 | 11/1987 |
| WO | WO 99/47634 | 9/1999 |
| WO | WO 00/06690 | 2/2000 |
| WO | WO 00/24852 | 5/2000 |

* cited by examiner

MULTI-PHASE FABRIC CARE COMPOSITION FOR DELIVERING MULTIPLE FABRIC CARE BENEFITS

CROSS-REFERENCE TO RELATED APPLICATION

This patent application claims the benefit of U.S. Provisional Application Ser. No. 60/212,565 filed Jun. 20, 2000 by M. J. Declercq, et al.; U.S. Provisional Application Ser. No. 60/263,973 filed Jan. 24, 2001 by M. J. Declercq, et al.; and U.S. Provisional Application Ser. No. 60/285,314 filed Apr. 20, 2001 by M. J. Declercq, et al.

BACKGROUND OF THE INVENTION

1. Field of the Invention

The present invention relates to rinse-added fabric care compositions and their use. In particular, the present invention relates to a multi-phase fabric care composition that is capable of not only delivering multiple fabric care benefits to a consumer's fabrics, but the appearance of the composition itself suggests a multiple benefit capability to the consumer.

2. Description of the Prior Art

Multi-phase compositions are known for use in cosmetic compositions such as in hair and skin cleaning and conditioning compositions. For instance, U.S. Pat. No. 3,718,609 discloses a liquid detergent composition that is particularly useful for bubble bath, bath oil, and shampoo compositions. U.S. Pat. No. 4,438,095 discloses the use of a two phase composition containing a cationic polymer and a vegetable oil as a hair conditioning composition. Japanese Patent Application No. 62059204 likewise teaches a hair rinse composition that is capable of separating into two layers. Further, U.S. Pat. No. 5,468,496 discloses a dermatological composition having an aqueous phase and an oily phase.

In addition, multi-phase compositions are known in the field of detergents for use in cleaning hard surfaces, among others. These compositions include those described in Japanese Patent Application Nos. JP 60243199A2, JP 61296099A2, and JP 62263297A2. Detergents specifically designed for hard surfaces and glass are also disclosed in PCT Application Publication No. WO 99/47634 and German Patent Application No. DE 2220540A1. Likewise, PCT Application Publication No. WO 024852A2 discloses a liquid detergent composition that appears to be designed for use on glass and other hard surfaces.

Multi-phase compositions have not previously been known or used in the field of liquid rinse-added fabric care compositions, or more specifically, rinse-added fabric softening compositions. Similarly, multi-phase fabric care compositions have not been known or used to deliver to the rinse bath solution a combination of fabric care agents that will impart multiple fabric care benefits to the fabrics in that solution. Furthermore, it has not been known or appreciated that a fabric care composition having multiple visually distinct phases will suggest to a consumer that the composition is capable of delivering multiple fabric care benefits.

SUMMARY OF THE INVENTION

The present invention provides a liquid rinse-added fabric care composition that is characterized by at least two visually distinct phases when the composition is at rest and wherein at least one of the phases contains a fabric care agent. The composition forms a temporary mixture when shaken that allows a consumer to dose a representative sample of the composition. The temporary mixture will spontaneously form at least two visually distinct phases within about 24 hours when allowed to remain at rest.

The two or more visually distinct phases of the composition may be continuous layers or may consist of a first phase suspended in a continuous second phase. Where two or more phases are continuous layers, at least two of the layers are at least about 1% by volume of the composition when the composition is at rest. Where a first phase is suspended in a second phase, the first phase has a length of at least about 1 mm when measured along its shortest axis. "Visually distinct" may refer to a visibly detectable difference in the appearance of the two phases (i.e., two or more phases with different reflected or transmitted light measurements), or it may refer to a visibly detectable division or demarcation between two phases that are similar in appearance (i.e., two phases with an elevated refractive index).

The fabric care agent present in one or more phases of the composition of the present invention may include fabric softener actives, color care agents, perfumes, antibacterial agents, malodor control agents, ultraviolet protection agents, anti-abrasion, anti-wear & fabric integrity agents, wrinkle control agents, and mixtures thereof. The composition should also contain less than about 5%, preferably less than about 3%, and even more preferably less than about 1% by weight of detergent actives. The composition optionally may contain an electrolyte, phase separation inducing polymer and/or a solvent having a ClogP of from about −2.0 to about 3.

The temporary mixture formed after shaking a composition of the present invention is sufficiently fluid and uniform to allow the sampling of a representative dose of the composition. The representative dose may have a viscosity of less than about 10 Pa.sec. when said viscosity is measured within about 1 minute after forming the temporary mixture. Further, the amount of active in the representative dose should vary less than about 5% from the average amount of active present in the total volume of the composition when said dose is sampled within about 5 seconds after forming the temporary mixture. Further still, the amount of active in the representative dose should vary less than about 10% from the average value of active present in the total volume of the composition when said active is sampled within about 15 seconds after forming the temporary mixture.

The present invention also provides a multi-phase fabric softening composition containing a fabric softener active having a transition temperature below about 30° C. in water. The composition may optionally contain an electrolyte, a phase separation inducing polymer, a phase modifier and/or a solvent having a ClogP of from −2.0 to about 3. When present, the polymer has a molecular weight above about 2000, and the ratio fabric softener active to polymer is less than about 50:1. When present, the electrolyte is present at a level such that the ratio of fabric softener active to electrolyte is less than about 50:1. When present, the ratio of fabric softener to solvent is between about 2:1 and about 10:1.

Methods of delivering a fabric care benefit to a fabric during a laundering operation using the compositions of the present invention are also provided. The methods comprise the steps of shaking a liquid rinse-added fabric care composition that has at least two visually distinct phases when the composition is at rest to form a uniform temporary mixture, and then dispensing a representative dose of the uniform temporary mixture to a laundry rinse bath solution containing the fabric to impart a fabric care benefit.

The present invention also provides a method for conveying information to a consumer concerning a liquid rinse-added fabric care composition that is capable of delivering multiple fabric care benefits. The method comprises the step of providing a liquid rinse-added fabric care composition that has at least two visually distinct phases, the presence of at least two phases suggesting to a consumer that the composition is capable of delivering more than one benefit. Preferably, the composition is provided in a container that enables a consumer to view the visually distinct phases present in the composition before purchasing or using the composition.

The present invention also provides an article of manufacture comprising a liquid rinse-added fabric care composition that has at least two visually distinct phases and a container for the composition that enables a consumer to view the visually distinct phases present in the composition.

DETAILED DESCRIPTION OF THE PREFERRED EMBODIMENTS

All percentages, ratios and proportions herein are by weight, unless otherwise specified. All temperatures are in degrees Celsius (° C.) unless otherwise specified. All documents cited are incorporated herein by reference in their entireties. Citation of any reference is not an admission regarding any determination as to its availability as prior art to the claimed invention.

As used herein, "comprising" means that other steps and other ingredients which do not affect the end of result can be added. This term encompasses the terms "consisting of" and "consisting essentially of".

As used herein, "detergent actives" refers to detergent surfactants, builders, chlorine bleaching agents and mixtures thereof. "Detergent surfactants" should be understood to refer to surfactants, primarily anionic surfactants, that are most well known for their detersive action in removing soil and stains from fabrics.

As used herein, the term "fabric article" means any fabric, fabric-containing, or fabric-like item that is laundered, conditioned, or treated on a regular, or irregular basis. Non-limiting examples of a fabric article include clothing, curtains, bed linens, wall hangings, textiles, cloth, etc. Preferably, the fabric article is a woven article, and more preferably, the fabric article is a woven article such as clothing. Furthermore, the fabric article may be made of natural and artificial materials, such as cotton, nylon, rayon, wool, and silk.

I. Fabric Care Compositions Having Visually Distinct Phases

A. Visually Distinct Phases

The rinse-added fabric care compositions of the present invention have at least two visually distinct phases. "Visually distinct" is primarily a qualitative determination but may easily be quantified based on a variety of available optical measurements known to those skilled in the art. Visually distinct phases in the composition of the present invention may have different colors, hues, intensities, degrees of clarity, densities as well as other visible characteristics.

Visual differences between phases may be determined by measuring the light that is reflected from or transmitted through them. For instance, light reflected from opaque or cloudy phases may be measured using any conventional technique, but may specifically be measured using a HunterLab D25 M photometer. Similarly, light that is transmitted through a phase may be measured using conventional techniques and devices designed for such measurements, but specifically may be measured using a HunterLab Colorquest XE photometer. Where the delta E value based on such measurements is equal to or greater than about 2, the two phases are visually distinct for purposes of the present invention. Delta E may be determined using the formula:

$$\text{delta } E=[(L_1-L_2)^2+(a_1-a_2)^2+(b_1-b_2)^2]^{1/2}$$

wherein L, a and b are derived from the tristimulus color values X, Y and Z according to the CIELAB system (Commision Internationale de I' Eclairage). Using instrumental color measurements, the position of any color can be located within this color space. The overall color difference between two specimens can be designated by delta E as defined above. As an example, ASTM D2244 describes the use of this system to quantify the color difference between opaque materials. Other testing techniques and devices may be used to establish that two phases are visually distinct from one another. However, such techniques will not be required where differences are more obvious such as in the case of phases that have different colors and degrees of clarity (i.e. one clear and one opaque). These relatively obvious visual distinctions may be confirmed such as by comparing the wavelengths of reflected light, by measuring the transmittance of light through the respective phases and by other conventional means.

Two or more phases that are similar in appearance may still be visually distinct where there is a visible division or line of demarcation between the phases. This may occur at the surface between layers or at the surface between a first phase suspended in a second phase. In such cases, visual distinction between the phases may also be confirmed by measuring the refractive index between the phases. The refractive index is a measurement of the change in direction of a beam of light passing through the interface between the two phases and is dependent on the difference in the densities of the two phases. Devices and procedures for determining the refractive index at an interface between two solutions are well known to those skilled in the art and need not be described in detail. Where the difference in refractive index is equal to or greater than about 0.02, the phases are visually distinct.

Further, in order for the two or more phases to be visually distinct, they should be present in the composition in sufficient quantity to be visibly detectable by the consumer. For instance, where at least two phases are present in the composition in the form of continuous layers, each visually distinct layer should be at least about 1%, preferably at least about 5% and even more preferably at least about 10% of the composition by volume so that each is visible when viewed by the consumer. Likewise, where a first phase is suspended in a continuous second phase, the first phase must be sufficiently large to be visible in the second phase. More specifically, the first phase should have a length of at least about 1 mm when measured along its shortest dimension, and preferably greater than about 3 mm and even more preferably greater than about 5 mm. Preferably, the visually distinct phases will be present in the composition in a volumetric ratio that is between about 3:1 and about 1:3, preferably between about 2:1 and about 1:2, and is more preferably about 1:1.

The presence of visually distinct phases in the compositions of the present invention provides several advantages over fabric care compositions known in the art. Foremost, the presence of visually distinct layers suggests to the consumer that the composition contains materials that are capable of delivering multiple fabric care benefits and thus aids in educating the consumer about the capabilities of the compositions. From a formulation perspective, the visually distinct phases within the compositions enable the use of materials that are not compatible or otherwise easily formulated into a stable single phase composition. Thus, the visually distinct phases enable the use of more effective, perhaps less expensive, materials that will not form a stable single phase fabric care composition. This is particularly advantageous for compositions containing cationic fabric softeners and the like.

B. Temporary Mixture

Another feature of the compositions of the present invention is the ability to form a temporary mixture of the composition by manual shaking the composition. Although not required, the fabric care agents in the compositions may be present in separate phases. In such a case, a mixture of the two phases is required in order to activate the composition and deliver the intended amount of each fabric care agent to the rinse bath solution. A temporary mixture of two or more phases is formed by the manual shaking of the composition. Extensive shaking manually or via mechanical means is not required. Rather, the compositions of the present invention are of such a nature that a temporary mixture may be achieved by simple manual shaking.

When the composition is contained within a container having a long axis or a cylindrical shape, the temporary mixture can be formed by repeatedly turning the container over its long axis for between about 15 seconds and about 45 seconds, but preferably for about 30 seconds. Further, the rate of rotation for the container during this shaking can be between about 20 and about 40 rotations per minute, but preferably will be about 30 rotations per minute. The formation of the temporary mixture in this manner should not be considered limiting as the temporary mixture may be formed using any conventional method. However, the method suggested to the consumer should not require excessive time or energy as either will deter the consumer from using the composition or, alternatively, from forming a temporary mixture that will deliver all of the intended the fabric care benefits. After shaking, the composition should spontaneously re-form at least two visually distinct phases when allowed to remain at rest. Formation of the visually distinct phases should be completed within the twenty four hours following the formation of the temporary mixture.

The temporary mixture formed after shaking or mixing the composition should be fluid and uniform in nature. In terms of fluidity, the composition should be flowable so that it may be accurately dosed from a container for dispensing in the rinse bath solution. The temporary mixture and a representative dose of the mixture should have a viscosity of less than about 10 Pa.sec., but preferably less than about 5 Pa.sec., and even more preferably less than about 1 Pa.sec. The viscosities of the temporary mixture and the representative dose may be determined using any conventional technique or viscometer. For instance, such viscosity measurements may be determined using a Brookfield LVF viscometer, using spindle 4 at about 60 rpm.

Likewise, a representative dose of the temporary mixture should have relatively the same composition as the composition as a whole. Specifically, the percentage of each fabric care agent in the representative dose will vary less than about 10%, preferably less than about 7% and even more preferably less than about 5% from the percentage of each fabric care agent in the total composition when the dose is sampled within about 5 seconds after forming the temporary mixture. Since the composition tends to re-form the visually distinct phases when the composition remains at rest, this variance will increase over time. When the representative dose is sampled about 15 seconds after forming the temporary mixture, each of the fabric care agents in the dose may vary up to about 15%, but preferably will be less than about 12%, and even more preferably less than about 10% from the amount of each fabric care agent in the composition as a whole. The amount of each fabric care agent in the representative dose may be determined by any conventional procedure known in the art. For instance, where the fabric care agent is a fabric softener active, the active level in the dose may be determined using the classical Epton two phase titration.

C. Fabric Care Agents

Fabric Softening Active

A fabric softening active useful in the compositions of the present invention is a quaternary ammonium compound of the formula:

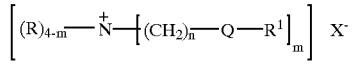

and mixtures thereof, wherein each R is independently selected from the group consisting of a $C_1$–$C_6$ alkyl, a $C_1$–$C_6$ hydroxyalkyl, and benzyl; each $R^1$ is independently selected from the group consisting of a $C_{11}$–$C_{22}$ linear alkyl, a $C_{11}$–$C_{22}$ branched alkyl, a $C_{11}$–$C_{22}$ linear alkenyl, and a $C_{11}$–$C_{22}$ branched alkenyl; each Q is independently a carbonyl moiety independently selected from the units having the formula:

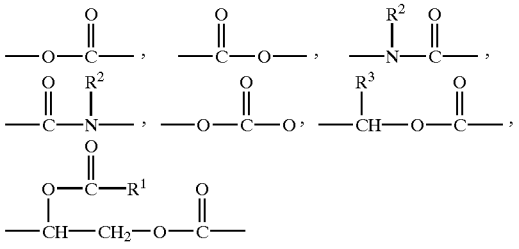

wherein each $R^2$ is independently selected from the group consisting of hydrogen, a $C_1$–$C_4$ alkyl, and a $C_1$–$C_4$ hydroxyalkyl; and each $R^3$ is independently selected from the group consisting of hydrogen and a $C_1$–$C_4$ alkyl, preferably each $R^3$ is independently a $C_1$–$C_4$ alkyl. In a preferred embodiment, each $R^3$ is independently hydrogen or methyl, more preferably methyl, and each Q independently has the formula:

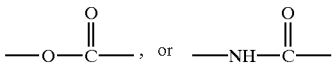

$X^-$ is a softener compatible anion, preferably the anion of a strong acid, for example, chloride, bromide, methylsulfate, ethylsulfate, sulfate, nitrate and a mixture thereof, more preferably chloride or methyl sulfate. The anion can also, but less preferably, carry a double charge, in which case $X^-$ represents half a group. The index m has a value of from about 1 to about 3; the index n has a value of from about 1 to about 4, preferably about 2 to about 3, and more preferably about 2. Preferably, m and n represent average values.

Amines and quaternized amines having two or more different values for the index n per molecule, for example, a softener active prepared from the starting amine methyl (3-aminopropyl)(2-hydroxyethyl)amine may also be used to advantage.

More preferred softener actives according to the present invention have the formula:

$$\left[(R)_{4-m}-\overset{+}{N}-\left[(CH_2)_n-O-\overset{O}{\overset{\|}{C}}-R^1\right]_m\right]X^-$$

wherein the unit having the formula:

$$-O-\overset{O}{\overset{\|}{C}}-R^1$$

is a fatty acyl moiety. Suitable fatty acyl moieties for use in the softener actives of the present invention are derived from sources of triglycerides including tallow, vegetable oils and/or partially hydrogenated vegetable oils including inter alia canola oil, safflower oil, peanut oil, sunflower oil, corn oil, soybean oil, tall oil, rice bran oil.

$R^1$ typically represents a mixture of linear and branched chains of both saturated and unsaturated aliphatic fatty acids, an example of which (canola oil), is described in Table A herein below. Nonlimiting examples of fatty acids are listed in U.S. Pat. No. 5,759,990 to Wahl, et al., issued on Jun. 2, 1998, at column 4, lines 45–66.

TABLE A

| Fatty acyl unit | % |
|---|---|
| C14 | 0–0.1 |
| C16 | 3–5.4 |
| C16:1 | 0.4–1 |
| C18 | 3–5.7 |
| C18:1 | 67.0–79 |
| C18:2 | 13–13.5 |
| C18:3 | 1–2.7 |
| C20 | 0.5 |
| C20:1 | 4.6 |

The formulator, depending upon the desired physical and performance properties of the final fabric softener active, may choose any of the above mentioned sources of fatty acyl moieties, or alternatively, may mix sources of triglyceride to form a "customized blend" with the C18:3 being preferred. However, those skilled in the art of fats and oils recognize that the fatty acyl composition may vary, as in the case of vegetable oil, from crop to crop, or from variety of vegetable oil source to variety of vegetable oil source. Fabric softening actives prepared using fatty acids derived from natural sources are preferred.

A preferred fabric softening active will contain $R^1$ units which have at least about 3%, preferably at least about 5%, more preferably at least about 10%, most preferably at least about 15% $C_{11}$–$C_{22}$ alkenyl, including polyalkenyl (polyunsaturated) units, inter alia, oleic, linoleic, linolenic.

The $R^1$ units suitable for use in the fabric softener actives of the present invention may be further characterized in that the Iodine Value (IV) of the parent fatty acid, said IV is preferably from about 10 to about 140, more preferably from about 50 to about 130, most preferably from about 70 to about 100 when R1 is in the form of a fatty acid. However, formulators, depending upon which embodiment of the present invention they choose to execute, may wish to add an amount of fatty acyl units which have Iodine Values outside the range listed herein above. For example, "hardened stock" (IV of less than or equal to about 10) may be combined with the source of fatty acid admixture to adjust the properties of the final fabric softening active.

A preferred source of fatty acyl units useful herein, especially fatty acyl units having branching, for example, "Guerbet branching", methyl, ethyl, etc. units substituted along the primary alkyl chain, is a synthetic source of fatty acyl units. For example, one or more fatty acyl units having a methyl branch at a "non-naturally occurring" position, for example, at the third carbon of a $C_{17}$ chain may be useful herein. What is meant herein by the term "non-naturally occurring" is "acyl units which are not found in significant (greater than about 0.1%) quantities is common fats and oils which serve as feedstocks for the source of triglycerides described herein." If the desired branched chain fatty acyl unit is unavailable from readily available natural feedstocks, therefore, a synthetic fatty acid may be suitably admixed with other synthetic materials or with other natural triglyceride derived sources of acyl units.

The fabric softening active precursor amine mixture is not fully quaternized, that is, some free amine having the general formula:

$$(R)_{3-m}-N-\left[(CH_2)_n-Q-R^1\right]_m$$

may still be present in the final fabric softening active mixture.

The fabric softener active may further comprise an amine of the formula:

$$(R)_{3-m}-N-\left[(CH_2)_n-Z\right]_m,$$

wherein Z is a hydroxy or primary amine functionality (e.g., —OH or $NH_2$). Not all of the Z units are fully reacted with a fatty acyl moiety which leaves an amount of amine and/or quaternized ammonium compound in the final fabric softener active admixture having one or more Z units unreacted, and thereby not transformed into an ester or amide.

Preferred amines are those having the formula:

$$[R^1-Q-(CH_2)n]-\underset{\underset{R}{|}}{N}-[(CH_2)_n-Q-R^1],$$

wherein $R^1$ is independently selected and defined as above, R is defined as above, Q is independently selected and defined as above, and n is independently selected and defined as above. In alternative embodiments, this compound may be quaternized as disclosed above.

The following are examples of preferred softener actives according to the present invention.

N,N-di(tallowyl-oxy-ethyl)-N,N-dimethyl ammonium chloride;

N,N-di(canolyl-oxy-ethyl)-N,N-dimethyl ammonium chloride;

N,N-di(tallowyl-oxy-ethyl)-N-methyl, N-(2-hydroxyethyl) ammonium methyl sulfate;

N,N-di(canolyl-oxy-ethyl)-N-methyl, N-(2-hydroxyethyl) ammonium methyl sulfate;

N,N-di(tallowylamidoethyl)-N-methyl, N-(2-hydroxyethyl) ammonium methyl sulfate;

N,N-di(2-tallowyloxy-2-oxo-ethyl)-N,N-dimethyl ammonium chloride;

N,N-di(2-canolyloxy-2-oxo-ethyl)-N,N-dimethyl ammonium chloride;

N,N-di(2-tallowyloxyethylcarbonyloxyethyl)-N,N-dimethyl ammonium chloride;

N, N-di(2-canolyloxyethylcarbonyloxyethyl)-N,N-dimethyl ammonium chloride;

N-(2-tallowoyloxy-2-ethyl)-N-(2-tallowyloxy-2-oxo-ethyl)-N,N-dimethyl ammonium chloride;

N-(2-canolyloxy-2-ethyl)-N-(2-canolyloxy-2-oxo-ethyl)-N,N-dimethyl ammonium chloride;

N,N,N-tri(tallowyl-oxy-ethyl)-N-methyl ammonium chloride;

N,N,N-tri(canolyl-oxy-ethyl)-N-methyl ammonium chloride;

N-(2-tallowyloxy-2-oxoethyl)-N-(tallowyl)-N,N-dimethyl ammonium chloride;

N-(2-canolyloxy-2-oxoethyl)-N-(canolyl)-N,N-dimethyl ammonium chloride;

1,2-ditallowyloxy-3-N,N,N-trimethylammoniopropane chloride; and 1,2-dicanolyloxy-3-N,N,N-trimethylammoniopropane chloride;

N-tallowyl-oxyethyl-N-tallowyl-amidopropyl-N-methylamine

N-tallowyl-oxyethyl-N-tallowyl-amidopropyl-N,N-dimethyl ammonium chloride;

and mixtures of the above actives.

Particularly preferred is N,N-di(tallowoyl-oxy-ethyl)-N,N-dimethyl ammonium chloride, where the tallow chains are at least partially unsaturated; N,N-di(canoloyl-oxy-ethyl)-N,N-dimethyl ammonium chloride; N,N-di(tallowyl-oxy-ethyl)-N-methyl, N-(2-hydroxyethyl) ammonium methyl sulfate; N,N-di(canolyl-oxy-ethyl)-N-methyl, N-(2-hydroxyethyl) ammonium methyl sulfate; and mixtures thereof.

In the compositions of the present invention, the fabric softener active or mixture of actives will be present at a level between about 1% and about 40% and more preferably between about 5% and about 35% by weight of the composition.

Perfumes

As used herein the term "perfume" is used to indicate any odoriferous material that is subsequently released into the aqueous bath and/or onto fabrics contacted therewith. The perfume will most often be liquid at ambient temperatures. A wide variety of chemicals are known for perfume uses, including materials such as aldehydes, ketones, and esters. More commonly, naturally occurring plant and animal oils and exudates comprising complex mixtures of various chemical components are known for use as perfumes. The perfumes herein can be relatively simple in their compositions or can comprise highly sophisticated complex mixtures of natural and synthetic chemical components, all chosen to provide any desired odor. Typical perfumes can comprise, for example, woody/earthy bases containing exotic materials such as sandalwood, civet and patchouli oil. The perfumes can be of a light floral fragrance, e.g. rose extract, violet extract, and lilac. The perfumes can also be formulated to provide desirable fruity odors, e.g. lime, lemon, and orange. Further, it is anticipated that so-called "designer fragrances" that are typically applied directly to the skin may be used in the compositions of the present invention. Likewise, the perfumes may be selected for an aromatherapy effect, such as providing a relaxing or invigorating mood. As such, any material that exudes a pleasant or otherwise desirable odor can be used as a perfume active in the compositions of the present invention.

The perfume active may also include pro-fragrances such as acetal profragrances, ketal pro-fragrances, ester pro-fragrances (e.g., digeranyl succinate), hydrolyzable inorganic-organic pro-fragrances, and mixtures thereof. These pro-fragrances may release the perfume material as a result of simple hydrolysis, or may be pH-change-triggered pro-fragrances (e.g. pH drop) or may be enzymatically releasable pro-fragrances.

In the compositions of the present invention, the perfume active or mixture of actives will be present at a level between about 0.05% and about 10% and more preferably between about 0.1% and about 5% by weight of the composition.

Wrinkle Control Agents

The composition may also contain an effective amount of a fabric wrinkle control agent that will provide body, form and drape control or smoothness to the treated fabrics. Typically, an "effective amount" will be between about 0.05% and about 10% and preferably between about 0.1% and about 7.5%, by weight of the composition. Preferably, these agents will be selected from the group consisting of fiber lubricants, shape retention polymers, hydrophilic plasticizers, lithium salts, and mixtures thereof.

1. Fiber Lubricants

The present invention may utilize a fiber lubricant to impart a lubricating property or increased gliding ability to fibers in fabric, particularly clothing. Not to be bound by theory, it is believed that water and other alcoholic solvents break or weaken the hydrogen bonds that hold the wrinkles, thus the fabric lubricant facilitates the fibers to glide on one another to further release the fibers from the wrinkle condition in wet or damp fabric. After the fabric is dried, a residual fiber lubricant can provide lubricity to reduce the tendency of fabric re-wrinkling.

a) Silicone Polymers

The present invention may utilize silicone to impart a lubricating property or increased gliding ability to fibers in fabric, particularly clothing. Nonlimiting examples of useful silicones include noncurable silicones such as polydimethylsilicone, polyalkyleneoxide modified polydimethylsilicone, amino and quaternary modified silicones and volatile silicones, and curable silicones such as aminosilicones and hydroxysilicones. Many types of aminofunctional silicones also cause fabric yellowing and such silicones are not preferred.

Non-limiting examples of silicones which are useful in the present invention are: non-volatile silicone fluids such as polydimethyl siloxane gums and fluids; volatile silicone fluid which can be a cyclic silicone fluid of the formula $[(CH_3)_2SiO]_n$ where n ranges between about 3 to about 7, preferably about 5, or a linear silicone polymer fluid having the formula $(CH_3)_3SiO[(CH_3)_2SiO]_mSi(CH_3)_3$ where m can be 0 or greater and has an average value such that the viscosity at about 25° C. of the silicone fluid is preferably about 5 centistokes or less.

Thus, one type of silicone that is useful in the composition of the present invention is polyalkyl silicone with the following structure:

$$A\text{-}(Si(R_2)\text{—}O\text{—}[Si(R_2)\text{—}O\text{—}]_q\text{—}Si(R_2)\text{-}A$$

The alkyl groups substituted on the siloxane chain (R) or at the ends of the siloxane chains (A) can have any structure as long as the resulting silicones remain fluid at room temperature.

Each R group preferably is alkyl, hydroxy, or hydroxyalkyl group, and mixtures thereof, having less than about 8, preferably less than about 6 carbon atoms, more preferably, each R group is methyl, ethyl, propyl, hydroxy group, and mixtures thereof. Most preferably, each R group is methyl. Aryl, alkylaryl and/or arylalkyl groups are not preferred. Each A group which blocks the ends of the silicone chain is hydrogen, methyl, methoxy, ethoxy, hydroxy, propoxy, and mixtures thereof, preferably methyl. q is preferably an integer from about 7 to about 8,000.

The preferred silicones are polydimethyl siloxanes and preferably those polydimethyl siloxanes having a viscosity of from about 10 to about 1000,000 centistokes at about 25° C. Mixtures of volatile silicones and non-volatile polydimethyl siloxanes are also preferred. Preferably, the silicones are hydrophobic, non-irritating, non-toxic, and not otherwise harmful when applied to fabric or when they come in contact with human skin. Further, the silicones are compatible with other components of the composition are chemically stable under normal use and storage conditions and are capable of being deposited on fabric.

Suitable methods for preparing these silicone materials are described in U.S. Pat. Nos. 2,826,551 and 3,964,500. Silicones useful in the present invention are also commercially available. Suitable examples include silicones offered by Dow Corning Corporation and General Electric Company.

Other useful silicone materials are of the formula:

$$HO—[Si(CH_3)_2—O]_x—\{Si(OH)[(CH_2)_3—NH—(CH_2)_2—NH_2]O\}_y—H$$

wherein x and y are integers which depend on the molecular weight of the silicone, preferably having a viscosity of from about 10,000 cst to about 500,000 cst at about 25° C. This material is also known as "aminodimethicone". Although silicones with a high number, e.g., greater than about 0.5 millimolar equivalent of amine groups can be used, they are not preferred because they can cause fabric yellowing.

Similarly, silicone materials which can be used correspond to the formulas:

$$(R^1)_aG_{3-a}—Si—(—OSiG_2)_n—(OSiG_b(R^1)_{2-b})_m—O—SiG_{3-a}(R^1)_a$$

wherein G is selected from the group consisting of hydrogen, OH, and/or $C_1$–$C_5$ alkyl; a denotes 0 or an integer from about 1 to about 3; b denotes 0 or 1; the sum of n+m is a number from 1 to about 2,000; $R^1$ is a monovalent radical of formula $CpH_{2p}L$ in which p is an integer from about 2 to about 4 and L is selected from the group consisting of:

$—N(R^2)CH_2—CH_2—N(R^2)_2$;

$—N(R^2)_2$;

$—N+(R^2)_3A^-$; and $—N+(R^2)CH_2—CH_2N+H_2A^-$ wherein each $R^2$ is selected from the group consisting of hydrogen, a $C_1$–$C_5$ saturated hydrocarbon radical, and each $A^-$ denotes a compatible anion, e.g., a halide ion; and $$R^3—N+(CH_3)_2\text{-}Z\text{-}[Si(CH_3)_2O]_f—Si(CH_3)_2\text{-}Z\text{-}N+(CH_3)_2—R^3.2CH_3COO^-$$

wherein z=$—CH_2—CH(OH)—CH_2O—CH_2)_2—$ $R^3$ denotes a long chain alkyl group; and f denotes an integer of at least about 2.

In the formulas herein, each definition is applied individually and averages are included.

Another silicone material which can be used has the formula:

$$(CH_3)_3—Si—[OSi(CH_3)_2]_n—\{—O—Si(CH_3)[(CH_2)_3—NH—(CH_2)_2—NH_2]\}_mOSi(CH_3)_3$$

wherein n and m are the same as before. The preferred silicones of this type are those which do not cause fabric discoloration.

Alternatively, the silicone material can be provided as a moiety or a part of a non-silicone molecule. Examples of such materials are copolymers containing silicone moieties, typically present as block and/or graft copolymers.

When silicone is present, it is present at least an effective amount to provide lubrication of the fibers. Typically, such silicones are effective in the compositions of the present invention at a level between about 0.05% and about 7.5% and preferably between about 0.1% and about 5% by weight of the composition.

b) Synthetic Solid Particles

Solid polymeric particles of average particle size smaller than about 10 microns, preferably smaller than about 5 microns, more preferably smaller than about 1 micron, may be used as a lubricant, since they can provide a "roller-bearing" action. Polyethylene emulsions and suspensions are also suitable for providing this lubrication or smoothness effect to the fabrics on which they are deposited. Suitable smoothing agents are available under the tradename VELUSTROL from HOECHST Aktiengesellschaft of Frankfurt am Main, Germany. In particular, the polyethylene emulsions sold under the tradename VELUSTROL PKS, VELUSTROL KPA, or VELUSTROL P-40 may be employed in the compositions of the present invention. The use of such polymers in fabric softening compositions is described in U.S. Pat. No. 5,830,843, 2. Shape Retention Polymers Shape retention may be imparted to fabrics through the use of polymers that act by forming a film and/or by providing adhesive properties to the fabrics. These polymers may be natural or synthetic. By "adhesive" it is meant that when applied as a solution or a dispersion, the polymer can attach to the surface of the fabric fibers and dry in place. The polymer can form a film on the fiber surfaces, or when residing between two fibers and in contact with the two fibers, it can bond the two fibers together. Other polymers such as starches can form a film and/or bond the fibers together when the treated fabric is pressed by a hot iron. Such a film will have adhesive strength, cohesive breaking strength, and cohesive breaking strain.

Nonlimiting examples of natural shape retention polymers are starches and their derivatives, and chitins and their derivatives. Starch is not normally preferred, since it makes the fabric resistant to deformation. However, it does provide increased "body" which is often desired. Starch is particularly preferred, however, when the consumer intends to iron the fabrics after they have been washed and dried. When used, starch may be used as a solid or solubilized or dispersed to be combined with other materials in the composition. Any type of starch, e.g., those derived from corn, wheat, rice, grain sorghum, waxy grain sorghum, waxy maize or tapioca, or mixtures thereof and water soluble or dispersible modifications or derivatives thereof, can be used in the compositions of the present invention. Modified starches may include natural starches that have been degraded to obtain a lower viscosity by acidic, oxidative or enzymic depolymerization. Additionally, low viscosity commercially available propoxylated and/or ethoxylated starches are usable in the present composition and are preferred when the composition is to be dispensed with a sprayer because of their low viscosity at relatively high solid concentrations. Suitable alkoxylated, low viscosity starches are submicron-size particles of hydrophobic starch that are readily dispersed in water and are prepared by alkoxylation of granular starch with a monofunctional alkoxylating agent which provides the starch with ether linked hydrophilic groups. A suitable method for their preparation is taught in U.S. Pat. No. 3,462,283.

Nonlimiting examples of monomers which can be used to form the synthetic polymers useful in the present invention include: low molecular weight $C_1$–$C_6$ unsaturated organic mono- and polycarboxylic acids, such as acrylic acid, methacrylic acid, crotonic acid, maleic acid and its half esters, itaconic acid, and mixtures thereof; esters of said acids with $C_1$–$C_6$ alcohols, such as methanol, ethanol, 1-propanol, 2-propanol, 1-butanol, 2-methyl-1-propanol, 1-pentanol, 2-pentanol, 3-pentanol, 2-methyl-1-butanol, 1-methyl-1-butanol, 3-methyl-1-butanol, 1-methyl-1-pentanol, 2-methyl-1-pentanol, 3-methyl-1-pentanol, t-butanol, cyclohexahol, 2-ethyl-1-butanol, and the like, and mixtures thereof. Nonlimiting examples of said esters are methyl acrylate, ethyl acrylate, t-butyl acrylate, methyl methacrylate, hydroxyethyl methacrylate, methoxy ethyl methacrylate, and mixtures thereof; amides and imides of said acids, such as N,N-dimethylacrylamide, N-t-butyl acrylamide, maleimides; low molecular weight unsaturated alcohols such as vinyl alcohol (produced by the hydrolysis of vinyl acetate after polymerization), alkyl alcohol; esters of said alcohols with low molecular weight carboxylic acids, such as, vinyl acetate, vinyl propionate; ethers of said alcohols such as methyl vinyl ether; polar vinyl heterocyclics, such as vinyl pyrrolidone, vinyl caprolactam, vinyl pyridine, vinyl imidazole, and mixtures thereof; other unsaturated amines and amides, such as vinyl amine, diethylene triamine, dimethylaminoethyl methacrylate, ethenyl formamide; vinyl sulfonate; salts of acids and amines listed above; low molecular weight unsaturated hydrocarbons and derivatives such as ethylene, propylene, butadiene, cyclohexadiene, vinyl chloride; vinylidene chloride; and mixtures thereof and alkyl quaternized derivatives thereof, and mixtures thereof.

Preferably, said monomers are selected from the group consisting of vinyl alcohol; acrylic acid; methacrylic acid; methyl acrylate; ethyl acrylate; methyl methacrylate; t-butyl acrylate; t-butyl methacrylate; n-butyl acrylate; n-butyl methacrylate; dimethylaminoethyl methacrylate; N,N-dimethyl acrylamide; N,N-dimethyl methacrylamide; N-t-butyl acrylamide; vinylpyrrolidone; vinyl pyridine; adipic acid; diethylenetriamine; salts thereof and alkyl quaternized derivatives thereof, and mixtures thereof. Preferably, said monomers form homopolymers and/or copolymers (i.e., the film-forming and/or adhesive polymer) having a glass transition temperature (Tg) of from about −20° C. to about 150° C., preferably from about −10° C. to about 150° C., more preferably from about 0° C. to about 100° C. Most preferably, the adhesive polymer when dried to form a film will have a Tg of at least about 25° C., so that they are not unduly sticky or "tacky" to the touch.

Preferably the shape retention polymer is soluble and/or dispersible in water and/or alcohol. Said polymer typically has a molecular weight of at least about 500, preferably from about 1,000 to about 2,000,000, more preferably from about 5,000 to about 1,000,000, and even more preferably from about 30,000 to about 300,000 for some polymers.

Some non-limiting examples of homopolymers and copolymers which are useful as film-forming and/or adhesive polymers in the present invention are: adipic acid/dimethylaminohydroxypropyl diethylenetriamine copolymer; adipic acid/epoxypropyl diethylenetriamine copolymer; poly(vinylpyrrolidone/dimethylaminoethyl methacrylate); polyvinyl alcohol; polyvinylpyridine n-oxide; methacryloyl ethyl betaine/methacrylates copolymer; ethyl acrylate/methyl methacrylate/methacrylic acid/acrylic acid copolymer; polyamine resins; and polyquaternary amine resins; poly(ethenylformamide); poly (vinylamine) hydrochloride; poly(vinyl alcohol-co-6% vinylamine); poly(vinyl alcohol-co-12% vinylamine); poly (vinyl alcohol-co-6% vinylamine hydrochloride); and poly (vinyl alcohol-co-12% vinylamine hydrochloride). Preferably, said copolymer and/or homopolymers are selected from the group consisting of adipic acid/dimethylaminohydroxypropyl diethylenetriamine copolymer; poly(vinylpyrrolidone/dimethylaminoethyl methacrylate); polyvinyl alcohol; ethyl acrylate/methyl methacrylate/methacrylic acid/acrylic acid copolymer; methacryloyl ethyl betaine/methacrylates copolymer; polyquaternary amine resins; poly(ethenylformamide); poly (vinylamine) hydrochloride; poly(vinyl alcohol-co-6% vinylamine); poly(vinyl alcohol-co-12% vinylamine); poly (vinyl alcohol-co-6% vinylamine hydrochloride); and poly (vinyl alcohol-co-12% vinylamine hydrochloride).

Nonlimiting examples of preferred polymers that are commercially available are polyvinylpyrrolidone/dimethylaminoethyl methacrylate copolymer, such as Copolymer 958, molecular weight of about 100,000 and Copolymer 937, molecular weight of about 1,000,000, available from GAF Chemicals Corporation; adipic acid/dimethylaminohydroxypropyl diethylenetriamine copolymer, such as Cartaretin F-4® and F-23, available from Sandoz Chemicals Corporation; methacryloyl ethyl betaine/methacrylates copolymer, such as Diaformer Z-SM®, available from Mitsubishi Chemicals Corporation; polyvinyl alcohol copolymer resin, such as Vinex 2019®, available from Air Products and Chemicals or Moweol®, available from Clariant; adipic acid/epoxypropyl diethylenetriamine copolymer, such as Delsette 101®, available from Hercules Incorporated; polyamine resins, such as Cypro 515®, available from Cytec Industries; polyquaternary amine resins, such as Kymene 557H®, available from Hercules Incorporated; and polyvinylpyrrolidone/acrylic acid, such as Sokalan EG 310®, available from BASF.

The preferred polymers that are useful in the present invention are selected from the group consisting of copolymers of hydrophilic monomers and hydrophobic monomers. The polymer can be linear random or block copolymers, and mixtures thereof. Such hydrophobic/hydrophilic copolymers typically have a hydrophobic monomer/hydrophilic monomer ratio of from about 95:5 to about 20:80, preferably from about 90:10 to about 40:60, more preferably from about 80:20 to about 50:50 by weight of the copolymer. The hydrophobic monomer can comprise a single hydrophobic monomer or a mixture of hydrophobic monomers, and the hydrophilic monomer can comprise a single hydrophilic monomer or a mixture of hydrophilic monomers. The term "hydrophobic" is used herein consistent with its standard meaning of lacking affinity for water, whereas "hydrophilic" is used herein consistent with its standard meaning of having affinity for water. As used herein in relation to monomer units and polymeric materials, including the copolymers, "hydrophobic" means substantially water insoluble; "hydrophilic" means substantially water soluble. In this regard, "substantially water insoluble" shall refer to a material that is not soluble in distilled (or equivalent) water, at about 25° C., at a concentration of about 0.2% by weight, and preferably not soluble at about 0.1% by weight (calculated on a water plus monomer or polymer weight basis). "Substantially water soluble" refers to a material that is soluble in distilled (or equivalent) water, at about 25° C., at a concentration of about 0.2% by weight, and is preferably soluble at about 1% by weight. The terms "soluble", "solubility" and the like, for purposes hereof, corresponds to the maximum concentration of monomer or polymer, as applicable, that can dissolve in water or other solvents to form a homogeneous solution, as is well understood to those skilled in the art.

Nonlimiting examples of useful hydrophobic monomers are acrylic acid $C_1$–$C_6$ alkyl esters, such as methyl acrylate, ethyl acrylate, t-butyl acrylate; methacrylic $C_1$–$C_6$ alkyl esters, such as methyl methacrylate, methoxy ethyl methacrylate; vinyl alcohol esters of carboxylic acids, such as, vinyl acetate, vinyl propionate, vinyl ethers, such as methyl vinyl ether; vinyl chloride; vinylidene chloride; ethylene, propylene and other unsaturated hydrocarbons; and the like; and mixtures thereof. Some preferred hydrophobic monomers are methyl acrylate, methyl methacrylate, t-butyl acrylate, t-butyl methacrylate, n-butyl acrylate, n-butyl methacrylate, and mixtures thereof.

Nonlimiting examples of useful hydrophilic monomers are unsaturated organic mono- and polycarboxylic acids, such as acrylic acid, methacrylic acid, crotonic acid, maleic acid and its half esters, itaconic acid; unsaturated alcohols, such as vinyl alcohol, allyl alcohol; polar vinyl heterocyclics, such as vinyl pyrrolidone, vinyl caprolactam, vinyl pyridine, vinyl imidazole; vinyl amine; vinyl sulfonate; unsaturated amides, such as acrylamides, e.g., N,N-dimethylacrylamide, N-t-butyl acrylamide; hydroxyethyl methacrylate; dimethylaminoethyl methacrylate; salts of acids and amines listed above; and the like; and mixtures thereof. Some preferred hydrophilic monomers are acrylic acid, methacrylic acid, N,N-dimethyl acrylamide, N,N-dimethyl methacrylamide, N-t-butyl acrylamide, dimethylamino ethyl methacrylate, vinyl pyrrolidone, salts thereof and alkyl quaternized derivatives thereof, and mixtures thereof.

Non-limiting examples of polymers for use in the present invention include the following, where the composition of the copolymer is given as approximate weight percentage of each monomer used in the polymerization reaction used to prepare the polymer: vinyl pyrrolidone/vinyl acetate copolymers (at ratios of up to about 30% by weight of vinyl pyrrolidone); vinyl pyrrolidone/vinyl acetate/butyl acrylate copolymer (10/78/12 and 10/70/20); vinyl pyrrolidone/vinyl propionate copolymer (5/95); vinyl caprolactam/vinyl acetate copolymer (5/95); and resins sold under the trade names Ultrahold CA 8® by Ciba Geigy (ethyl acrylate/acrylic acid/N-t-butyl acrylamide copolymer); Resyn 28-1310® by National Starch and Luviset CA 66® by BASF (vinyl acetate/crotonic acid copolymer 90/10); Luviset CAP® by BASF (vinyl acetate/vinyl propionate/crotonic acid 50/40/10); Amerhold DR-25® by Union Carbide (ethyl acrylate/methacrylic acid/methyl methacrylate/acrylic acid copolymer), and Poligen A® by BASF (polyacrylate dispersion).

One highly preferred polymer is composed of acrylic acid and t-butyl acrylate monomeric units, preferably with acrylic acid/t-butyl acrylate ratio of from about 90:10 to about 10:90, preferably from about 70:30 to about 15:85, more preferably from about 50:50 to about 20:80, by weight of the polymer. Nonlimiting examples of acrylic acid/tert-butyl acrylate copolymers useful in the present invention are those with an approximate acrylic acid/tert-butyl acrylate weight ratio of about 25:75 and an average molecular weight of from about 70,000 to about 100,000, and those with an approximate acrylic acid/tert-butyl acrylate weight ratio of about 35:65 and an average molecular weight of from about 60,000 to about 90,000.

The film-forming and/or adhesive polymer is present in at least an effective amount to provide shape retention. Typically, such polymers are effective at a concentration in the compositions of the present invention at a level between about 0.05% and about 7.5% and preferably between about 0.1% and about 5% by weight of the composition.

Silicones, typical wrinkle reducing agents, and film-forming polymers can be combined to produce preferred wrinkle reducing actives. Typically the weight ratio of silicone to film-forming polymer is from about 10:1 to about 1:10, preferably from about 5:1 to about 1:5, and more preferably from about 2:1 to about 1:2.

Other preferred adhesive and/or film forming polymers that are useful in the composition of the present invention actually contain silicone moieties in the polymers themselves, typically present as block and/or graft copolymers.

The preferred polymers for use herein have the characteristic of providing a natural appearing "drape" in which the fabric does not form wrinkles, or resists deformation.

3. Hydrophilic Plasticizer

Compositions may also contain a hydrophilic plasticizer to soften the fabric fibers, especially cotton fibers, and the adhesive and/or film-forming shape retention polymers. Examples of the preferred hydrophilic plasticizers are short chain polyhydric alcohols, such as glycerol, ethylene glycol, propylene glycol, diethylene glycol, dipropylene glycol, sorbitol, erythritol or mixtures thereof, more preferably diethylene glycol, dipropylene glycol, ethylene glycol, propylene glycol and mixtures thereof.

The aqueous compositions containing these plasticizers also tend to provide a slower drying profile for clothing/fabrics, to allow time for any wrinkles to disappear when the clothing/fabrics are hung to dry. This is balanced by the desire by most consumer to have the garments dry faster. Therefore, when needed, the plasticizers should be used at an effective, but as low as possible, level in the composition.

4. Lithium Salts

The compositions of the present invention may further contain lithium salts and lithium salt hydrates to provide improved fabric wrinkle control. Nonlimiting examples of lithium salts that are useful in the present invention are lithium bromide, lithium bromide hydrate, lithium chloride, lithium chloride hydrate, lithium acetate, lithium acetate dihydrate, lithium lactate, lithium sulfate, lithium sulfate monohydrate, lithium tartrate, lithium bitartrate, and mixtures thereof, preferably lithium bromide, lithium lactate, and mixtures thereof.

5. Mixtures

As stated hereinbefore, the compositions of the present invention may also contain mixtures of fiber lubricant, shape retention polymer, plasticizer, and/or lithium salts to impart improved wrinkle control to the fabrics.

Sanitization Agents

Sanitization of fabrics can be achieved by the compositions and articles of the present invention containing, antimicrobial materials, e.g., antibacterial halogenated compounds, quaternary compounds, phenolic compounds and metallic salts, and preferably quaternary compounds. A typical disclosure of these antimicrobial can be found in International Patent Application No. PCT/US 98/12154 pages 17 to 20.

1. Biguanides

Some of the more robust antimicrobial halogenated compounds which can function as disinfectants/sanitizers as well as finish product preservatives (vide infra), and that are useful in the compositions of the present invention include 1,1'-hexamethylene bis(5-(p-chlorophenyl)biguanide), commonly known as chlorhexidine, and its salts, e.g., with hydrochloric, acetic and gluconic acids. The digluconate salt is highly water-soluble, about 70% in water, and the diacetate salt has a solubility of about 1.8% in water.

Other useful biguanide compounds include Cosmoci® CQ®, and Vantocil® IB that include poly (hexamethylene biguanide) hydrochloride. Other useful cationic antimicrobial agents include the bis-biguanide alkanes. Usable water soluble salts of the above are chlorides, bromides, sulfates, alkyl sulfonates such as methyl sulfonate and ethyl sulfonate, phenylsulfonates such as p-methylphenyl sulfonates, nitrates, acetates, gluconates, and the like. As stated hereinbefore, the bis biguanide of choice is chlorhexidine its salts, e.g., digluconate, dihydrochloride, diacetate, and mixtures thereof.

2. Quaternary Compounds

A wide range of quaternary compounds can also be used as antimicrobial actives for the compositions of the present invention. Non-limiting examples of useful quaternary compounds include: (1) benzalkonium chlorides and/or substituted benzalkonium chlorides such as commercially available Barquat® (available from Lonza), Maquat® (available from Mason), Variquat® (available from Goldschmidt), and Hyamine® (available from Lonza); (2) di($C_6$–$C_{14}$)alkyl di short chain ($C_{1-4}$ alkyl and/or hydroxyalkyl) quaternary such as Bardac® products of Lonza, (3) N-(3-chloroallyl) hexaminium chlorides such as Dowicide® and Dowicil® available from Dow; (4) benzethonium chloride such as Hyamine® 1622 from Rohm & Haas; (5) methylbenzethonium chloride represented by Hyamine® 10X supplied by Rohm & Haas, (6) cetylpyridinium chloride such as Cepacol chloride available from of Merrell Labs. Examples of the preferred dialkyl quaternary compounds are di($C_8$–$C_{12}$) dialkyl dimethyl ammonium chloride, such as didecyldimethylammonium chloride (Bardac 22), and dioctyidimethylammonium chloride (Bardac 2050).

Surfactants, when added to the antimicrobials, tend to provide improved antimicrobial action. This is especially true for the siloxane surfactants, and especially when the siloxane surfactants are combined with the chlorhexidine antimicrobial actives.

Examples of bactericides used in the compositions and articles of this invention include glutaraldehyde, formaldehyde, 2-bromo-2-nitro-propane-1,3-diol sold by Inolex Chemicals, located in Philadelphia, Pa., under the trade name Bronopol®, and a mixture of 5-chloro-2-methyl-4-isothiazoline-3-one and 2-methyl-4-isothiazoline-3-one sold by Rohm and Haas Company under the trade name Kathon CG/ICP®.

3. Metallic Salts

Many metallic salts are known for their antimicrobial effects and are described in the following section in association with their use as malodor control agents.

Malodor Control Agents

Materials for use in odor control may be of the type disclosed in U.S. Pat. Nos. 5,534,165; 5,578,563; 5,663,134; 5,668,097; 5,670,475; and 5,714,137, Trinh , et al. issued Jul. 9, 1996; Nov. 26, 1996; Sep. 2, 1997; Sep. 16, 1997; Sep. 23, 1997; and Feb. 3, 1998, respectively, all of said patents being incorporated herein by reference. Such compositions can contain several different optional odor control agents.

1. Pro-perfumes

A pro-perfume may be useful in order to mask malodor on fabric. A pro-perfume is defined as a perfume precursor that releases a desirable odor and/or perfume molecule through the breaking of a chemical bond. Typically to form a pro-perfume, a desired perfume raw material is chemically linked with a carrier, preferably a slightly volatile or a sparingly volatile carrier. The combination results in a less volatile and more hydrophobic pro-perfume which results in increased deposition onto the fabric article. The perfume is then released by breaking the bond between the perfume raw material and the carrier either through a change in pH (e.g., due to perspiration during wear), air moisture, heat, enzymatic action and/or sunlight during storage or line drying. Thus, malodor is effectively masked by the release of the perfume raw material. Thus, a pro-perfume requires a perfume raw material.

A perfume raw material is typically a saturated or unsaturated, volatile compound which contains an alcohol, an aldehyde, and/or a ketone group. The perfume raw material useful herein includes fragrant substance or mixture of substances including natural (i.e., obtained by extraction of flowers, herbs, leaves, roots, barks, wood, blossoms or plants), artificial (i.e., a mixture of different nature oils or oil constituents) and synthetic (i.e., synthetically produced) odoriferous substances. Such materials are often accompanied by auxiliary materials, such as fixatives, extenders, stabilizers and solvents. These auxiliaries are also included within the meaning of "perfume", as used herein. Typically, perfumes are complex mixtures of a plurality of organic compounds. The perfume raw materials useful in the present invention are described in more detail above.

2. Cyclodextrin

As used herein, the term "cyclodextrin" includes any of the known cyclodextrins such as unsubstituted cyclodextrins containing from six to twelve glucose units, especially, alpha-cyclodextrin, beta-cyclodextrin, gamma-cyclodextrin and/or their derivatives and/or mixtures thereof. The alpha-cyclodextrin consists of six glucose units, the beta-cyclodextrin consists of seven glucose units, and the gamma-cyclodextrin consists of eight glucose units arranged in donut-shaped rings. The specific coupling and conformation of the glucose units give the cyclodextrins rigid, conical molecular structures with hollow interiors of specific volumes. The "lining" of each internal cavity is formed by hydrogen atoms and glycosidic bridging oxygen atoms; therefore, this surface is fairly hydrophobic. The unique shape and physical-chemical properties of the cavity enable the cyclodextrin molecules to absorb (form inclusion complexes with) organic molecules or parts of organic molecules which can fit into the cavity. Many odorous molecules can fit into the cavity including many malodorous molecules and perfume molecules. Therefore, cyclodextrins, and especially mixtures of cyclodextrins with different size cavities, can be used to control odors caused by a broad spectrum of organic odoriferous materials, which may, or may not, contain reactive functional groups.

The complexing between cyclodextrin and odorous molecules occurs rapidly in the presence of water. However, the extent of the complex formation also depends on the polarity of the absorbed molecules. In an aqueous solution, strongly hydrophilic molecules (those which are highly water-soluble) are only partially absorbed, if at all. Therefore, cyclodextrin does not complex effectively with some very low molecular weight organic amines and acids when they are present at low levels. As the water is removed however, e.g., through drying, some low molecular weight organic amines and acids have more affinity and will tend to complex with the cyclodextrins more readily.

The cavities within the cyclodextrin should remain essentially unfilled (the cyclodextrin remains uncomplexed) while in solution, in order to allow the cyclodextrin to absorb various odor molecules when the solution is applied to a surface. Non-derivatised (normal) beta-cyclodextrin can be present at a level up to its solubility limit of about 1.85% (about 1.85 g in 100 grams of water) at room temperature. Beta-cyclodextrin is not preferred in compositions which call for a level of cyclodextrin higher than its water solubility limit. Non-derivatised beta-cyclodextrin is generally not preferred when the composition contains surfactant since it affects the surface activity of most of the preferred surfactants that are compatible with the derivatised cyclodextrins.

Cyclodextrins that are useful in the present invention are highly water-soluble such as, alpha-cyclodextrin and/or derivatives thereof, gamma-cyclodextrin and/or derivatives thereof, derivatised beta-cyclodextrins, and/or mixtures thereof. The derivatives of cyclodextrin consist mainly of molecules wherein some of the OH groups are converted to OR groups. Cyclodextrin derivatives include, e.g., those with short chain alkyl groups such as methylated cyclodextrins, and ethylated cyclodextrins, wherein R is a methyl or an ethyl group; those with hydroxyalkyl substituted groups, such as hydroxypropyl cyclodextrins and/or hydroxyethyl cyclodextrins, wherein R is a —$CH_2$—CH(OH)—$CH_3$ or a $^-CH_2CH_2$—OH group; branched cyclodextrins such as maltose-bonded cyclodextrins; cationic cyclodextrins such as those containing 2-hydroxy-3-(dimethylamino)propyl ether, wherein R is $CH_2$—CH(OH)—$CH_2$—$N(CH_3)_2$ which is cationic at low pH; quaternary ammonium, e.g., 2-hydroxy-3-(trimethylammonio) propyl ether chloride groups, wherein R is $CH_2$—CH(OH)—$CH_2$—$N^+(CH_3)_3Cl^-$; anionic cyclodextrins such as carboxymethyl cyclodextrins, cyclodextrin sulfates, and cyclodextrin succinylates; amphoteric cyclodextrins such as carboxymethyl/quaternary ammonium cyclodextrins; cyclodextrins wherein at least one glucopyranose unit has a 3-6-anhydro-cyclomalto structure, e.g., the mono-3-6-anhydrocyclodextrins, as disclosed in "Optimal Performances with Minimal Chemical Modification of Cyclodextrins", F. Diedaini-Pilard and B. Perly, The 7th International Cyclodextrin Symposium Abstracts, April 1994, p. 49, said references being incorporated herein by reference; and mixtures thereof. Other cyclodextrin derivatives are disclosed in U.S. Pat. Nos.: 3,426,011; 3,453,257; 3,453,258; 3,453,259; 3,453,260; 3,459,731; 3,553,191; 3,565,887; 4,535,152; 4,616,008; 4,678,598; 4,638,058; and 4,746,734.

Highly water-soluble cyclodextrins are those having water solubility of at least about 10 g in 100 ml of water at room temperature, preferably at least about 20 g in 100 ml of water, more preferably at least about 25 g in 100 ml of water at room temperature. The availability of solubilized, uncomplexed cyclodextrins is essential for effective and efficient odor control performance. Solubilized, water-soluble cyclodextrin can exhibit more efficient odor control performance than non-water-soluble cyclodextrin when deposited onto surfaces, especially fabric.

Examples of preferred water-soluble cyclodextrin derivatives suitable for use herein are hydroxypropyl alpha-cyclodextrin, methylated alpha-cyclodextrin, methylated beta-cyclodextrin, hydroxyethyl beta-cyclodextrin, and hydroxypropyl beta-cyclodextrin. Hydroxyalkyl cyclodextrin derivatives preferably have a degree of substitution of from about 1 to about 14, more preferably from about 1.5 to about 7, wherein the total number of OR groups per cyclodextrin is defined as the degree of substitution. Methylated cyclodextrin derivatives typically have a degree of substitution of from about 1 to about 18, preferably from about 3 to about 16. A known methylated beta-cyclodextrin is heptakis-2,6-di-O-methyl-β-cyclodextrin, commonly known as DIMEB, in which each glucose unit has about 2 methyl groups with a degree of substitution of about 14. A preferred, more commercially available, methylated beta-cyclodextrin is a randomly methylated beta-cyclodextrin, commonly known as RAMEB, having different degrees of substitution, normally of about 12.6. RAMEB is more preferred than DIMEB, since DIMEB affects the surface activity of the preferred surfactants more than RAMEB. The preferred cyclodextrins are available, e.g., from Cerestar USA, Inc. and Wacker Chemicals (USA), Inc.

It is also preferable to use a mixture of cyclodextrins. Such mixtures absorb odors more broadly by complexing with a wider range of odoriferous molecules having a wider range of molecular sizes. Preferably at least a portion of the cyclodextrins is alpha-cyclodextrin and its derivatives thereof, gamma-cyclodextrin and its derivatives thereof, and/or derivatised beta-cyclodextrin, more preferably a mixture of alpha-cyclodextrin, or an alpha-cyclodextrin derivative, and derivatised beta-cyclodextrin, even more preferably a mixture of derivatised alpha-cyclodextrin and derivatised beta-cyclodextrin, most preferably a mixture of hydroxypropyl alpha-cyclodextrin and hydroxypropyl beta-cyclodextrin, and/or a mixture of methylated alpha-cyclodextrin and methylated beta-cyclodextrin.

3. Low Molecular Weight Polyols

Low molecular weight polyols with relatively high boiling points, as compared to water, such as ethylene glycol, propylene glycol and/or glycerol are preferred optional ingredients for improving odor control performance of the composition of the present invention, especially when cyclodextrin is present. The incorporation of a small amount of low molecular weight glycols into the compositions and articles of the present invention typically enhances the formation of the cyclodextrin inclusion complexes as the treated fabrics dry.

The polyols' ability to remain on the fabric for a longer period of time than water, as the fabrics dry, typically allows them to form ternary complexes with the cyclodextrin and some malodorous molecules. The addition of the glycols tends to fill up void space in the cyclodextrin cavity that is unable to be filled by some malodor molecules of relatively smaller sizes. Preferably the glycol used is glycerin, ethylene glycol, propylene glycol, diethylene glycol, dipropylene glycol or mixtures thereof, and more preferably ethylene glycol and/or propylene glycol. Cyclodextrins prepared by processes that result in a level of such polyols are highly desirable, since they can be used without removal of the polyols.

Some polyols, e.g., dipropylene glycol, are also useful to facilitate the solubilization of some perfume ingredients in the composition of the present invention.

Typically, glycol is added to a composition of the present invention at a level of from about 0.01% to about 3%, by weight of the composition, preferably from about 0.05% to about 1%, more preferably from about 0.1% to about 0.5%, by weight of the composition. The preferred weight ratio of low molecular weight polyol to cyclodextrin is from about 2:1,000 to about 20:100, more preferably from about 3:1,000 to about 15:100, even more preferably from about 5:1,000 to about 10:100, and most preferably from about 1:100 to about 7:100.

4. Metal Salts

Optionally, but highly preferred, the present invention can include metallic salts for added odor absorption and/or antimicrobial benefit particularly when cyclodextrin is present. The metallic salts are selected from the group consisting of copper salts, zinc salts, and mixtures thereof.

Copper salts have some antimicrobial benefits. Specifically, cupric abietate acts as a fungicide, copper acetate acts as a mildew inhibitor, cupric chloride acts as a fungicide, copper lactate acts as a fungicide, and copper sulfate acts as a germicide. Copper salts also possess some malodor control abilities. See U.S. Pat. No. 3,172,817, which discloses deodorizing compositions for treating disposable articles, comprising at least slightly water-soluble salts of acetylacetone, including copper salts and zinc salts, all of said patents are incorporated herein by reference.

The preferred zinc salts possess malodor control abilities. Zinc has been used most often for its ability to ameliorate malodor, e.g., in mouth wash products, as disclosed in U.S. Pat. Nos. 4,325,939, and 4,469,674. Highly-ionized and soluble zinc salts, such as zinc chloride, provide the best source of zinc ions. Zinc borate functions as a fungistat and a mildew inhibitor, zinc caprylate functions as a fungicide, zinc chloride provides antiseptic and deodorant benefits, zinc ricinoleate functions as a fungicide, zinc sulfate heptahydrate functions as a fungicide and zinc undecylenate functions as a fungistat.

Preferably, the metallic salts are water-soluble zinc salts, copper salts or mixtures thereof, and more preferably zinc salts, especially $ZnCl_2$. These salts are preferably present in the present invention primarily to absorb amine and sulfur-containing compounds that have molecular sizes too small to be effectively complexed with the cyclodextrin molecules. Low molecular weight sulfur-containing materials, e.g., sulfide and mercaptans, are components of many types of malodors, e.g., food odors (garlic, onion), body/perspiration odor, breath odor, etc. Low molecular weight amines are also components of many malodors, e.g., food odors, body odors, urine, etc.

When metallic salts are added to the composition of the present invention they are typically present at a level of from about 0.1% to about 10%, preferably from about 0.2% to about 8%, more preferably from about 0.3% to about 5% by weight of the composition.

5. Soluble Carbonate and/or Bicarbonate Salts

Water-soluble alkali metal carbonate and/or bicarbonate salts, such as sodium bicarbonate, potassium bicarbonate, potassium carbonate, cesium carbonate, sodium carbonate, and mixtures thereof can be added to the composition of the present invention in order to help to control certain acid-type odors. Preferred salts are sodium carbonate monohydrate, potassium carbonate, sodium bicarbonate, potassium bicarbonate, and mixtures thereof. When these salts are used in a composition of the present invention, they are typically present at a level of from about 0.1% to about 5%, preferably from about 0.2% to about 3%, more preferably from about 0.3% to about 2%, by weight of the composition. When these salts are added to a composition of the present invention it is preferable that incompatible metal salts are not present in the composition. Preferably, when these salts are used the composition should be essentially free of zinc and other incompatible metal ions, e.g., Ca, Fe, Ba, etc. which form water-insoluble salts 6. Enzymes Enzymes can be used to control certain types of malodor, especially malodor from urine and other types of excretions, including regurgitated materials.

Proteases are especially desirable. The activity of commercial enzymes depends very much on the type and purity of the enzyme being considered. Enzymes that are water soluble proteases like pepsin, tripsin, ficin, bromelin, papain, rennin, and mixtures thereof are particularly useful. Non-limiting examples of suitable, commercially available, water soluble proteases are pepsin, tripsin, ficin, bromelin, papain, rennin, and mixtures thereof. Papain can be isolated, e.g., from papaya latex, and is available commercially in the purified form of up to, e.g., about 80% protein, or cruder, technical grade of much lower activity. Other suitable examples of proteases are the subtilisins which are obtained from particular strains of *B. subtilis* and *B. licheniforms*. Another suitable protease is obtained from a strain of *Bacillus*, having maximum activity throughout the pH range of about 8–12, developed and sold by Novo Industries A/S under the registered trade name ESPERASE®. The preparation of this enzyme and analogous enzymes is described in British Patent Specification No. 1,243,784. Proteolytic enzymes suitable for removing protein-based stains that are commercially available include those sold under the trade names ALCALASE® and SAVINASE® by Novo Industries A/S (Denmark) and MAXATASE® by International Bio-Synthetics, Inc. (The Netherlands). Other proteases include Protease A (see European Patent Application 130,756, published Jan. 9, 1985); Protease B (see European Patent Application Serial No. 87303761.8, and European Patent Application 130,756); and proteases made by Genencor International, Inc., according to one or more of the following patents: U.S. Pat. Nos. 5,185,258, 5,204,015 and 5,244,791.

A wide range of enzyme materials and means for their incorporation into compositions are also disclosed in U.S. Pat. No. 3,553,139. Enzymes are further disclosed in U.S. Pat. No. 4,101,457 and in U.S. Pat. No. 4,507,219. Other enzyme materials useful for liquid formulations, and their incorporation into such formulations, are disclosed in U.S. Pat. No. 4,261,868. Enzymes can be stabilized by various techniques, e.g., those disclosed and exemplified in U.S. Pat. No. 3,600,319, European Patent Application Publication No. 0 199 405, and in U.S. Pat. No. 3,519,570.

Enzyme-polyethylene glycol conjugates are also preferred. Such polyethylene glycol (PEG) derivatives of enzymes, wherein the PEG or alkoxy-PEG moieties are coupled to the protein molecule through, e.g., secondary amine linkages. Suitable derivatization decreases immunogenicity, thus minimizes allergic reactions, while still maintaining some enzymatic activity. An example of protease-PEG's is PEG-subtilisin Carlsberg from *B. licheniformis* coupled to methoxy-PEGs through secondary amine linkage, and is available from Sigma-Aldrich Corp., St. Louis, Mo.

Enzymes and mixtures of enzymes are present in the compositions of present invention at levels between about 0.05% and about 5% and preferably between about 0.1% and about 3%.

7. Zeolites

When the clarity of the solution is not needed, and the solution is not sprayed on fabrics, other optional odor absorbing materials, e.g., zeolites and/or activated carbon, can also be used. Zeolites and mixtures of zeolites may be used in the compositions of the present invention at levels of between about 0.05% and about 7.5% and preferably between about 0.1% and about 5.0%.

A preferred class of zeolites is characterized as "intermediate" silicate/aluminate zeolites. The intermediate zeolites are characterized by $SiO_2/AlO_2$ molar ratios of less than about 10. Preferably the molar ratio of $SiO_2/AlO_2$ ranges from about 2 to about 10. The intermediate zeolites have an advantage over the "high" zeolites. The intermediate zeolites have a higher affinity for amine-type odors, they are more weight efficient for odor absorption because they have a larger surface area, and they are more moisture tolerant and retain more of their odor absorbing capacity in water than the high zeolites. A wide variety of intermediate zeolites suitable for use herein are commercially available as Valfor® CP301-68, Valfor® 300-63, Valfor® CP300-35, and Valfor® CP300-56, available from PQ Corporation, and the CBV100® series of zeolites from Conteka.

Zeolite materials marketed under the trade name Abscents® and Smellrite®, available from The Union Carbide Corporation and UOP are also preferred. These materials are typically available as a white powder in the 3–5 micron particle size range. Such materials are preferred over the intermediate zeolites for control of sulfur-containing odors, e.g., thiols, mercaptans.

8. Activated Carbon

The carbon material suitable for use in the present invention is the material well known in commercial practice as an absorbent for organic molecules and/or for air purification purposes. Often, such carbon material is referred to as "activated" carbon or "activated" charcoal. Such carbon is available from commercial sources under such trade names as; Calgon-Type CPG®; Type PCB®; Type SGL®; Type CAL®; and Type OL®. Activated carbon fibers and cloth may also be used in combination with the compositions and/or articles of manufacture disclosed herein to provide malodor removal and/or freshness benefits. Such activated carbon fibers and fabrics can be acquired from Calgon. Activated carbon may be used in the compositions of the present invention at levels of between about 0.05% and about 7.5% and preferably between about 0.1% and about 5.0%.

9. Mixtures Thereof

Mixtures of the optional odor control agents described above are desirable, especially when the mixture provides control over a broader range of odors.

Color Control Agents

In the laundry operation, especially an operation involving automatic washing machines such as is envisioned in the use of the compositions and articles of the present invention, dye transfer occurs primarily during the wash cycle. This dye transfer during the wash cycle is caused by higher water temperature, longer cycle times, and much higher surfactant concentration in the wash cycle, as compared to the less stringent conditions of the rinse cycle. Thus, it is well known to those skilled in the art to inhibit dye transfer by adding dye transfer inhibitors to detergent compositions in the wash bath solution. For example, European Patent Application 265,257, Clements, et al., published Apr. 27, 1988, discloses detergent compositions containing a detergent active, a detergent builder, and a polyvinylpyrrolidone (PVP) mixture. German Pat. No. 3,519,012, Weber, et al., published Nov. 27, 1986, teaches a detergent composition comprising nonionic surfactants, PVP components, water-soluble cationic components, and builders, to prevent dye transfer during the wash.

In addition, the use of chlorine scavengers, dye fixatives, dye transfer inhibitors and chelants in a rinse solution is likewise well known to inhibit dye transfer and color degradation during the present rinse cycle as well as during subsequent wash cycles.

1. Chlorine Scavengers

Chlorine scavengers are actives that react with chlorine, or with chlorine-generating materials, such as hypochlorite, to eliminate or reduce the bleaching activity of the chlorine materials. When used in combination with a rinse-added fabric softener, compositions of this invention should incorporate enough chlorine scavenger to neutralize about 0.1 ppm to about 40 ppm, preferably from about 0.2 ppm to about 20 ppm, and even more preferably from about 0.3 ppm to about 10 ppm of chlorine in rinse water. Typically, chlorine scavengers and mixtures thereof may be used in the compositions of the present invention at levels of between about 0.05% and about 15% and preferably between about 0.1% and about 10.0% by weight of the composition.

Chlorine is used in many parts of the world to sanitize water. To make sure that the water is safe, a small amount of chlorine is left in the water, typically about 1 to about 2 ppm. It has been found that this small amount of chlorine in the tap water can cause fading of some fabric dyes. Incorporation of a chlorine scavenger in the wash bath solution can provide a benefit by placing the chlorine scavenger at a point where it can intercept the chlorine in the wash water, especially when the chlorine scavenger is highly water soluble, e.g., an ammonium salt as disclosed hereinafter. The chlorine scavenger in the rinse bath solution neutralizes the chlorine in the rinse water where there is no other product added. Further, better distribution of the chlorine scavenger is achieved in the rinse which provides better protection by spreading the scavenger over the fabric more evenly.

The compositions of the present invention should comprise enough chlorine scavenger to react with about 0.1 ppm to about 40 ppm, preferably from about 0.2 ppm to about 20 ppm, and more preferably from about 0.3 ppm to about 10 ppm of chlorine present in an average wash liquor. If both the cation and the anion of the scavenger react with chlorine, which is desirable, the level is adjusted to react with an equivalent amount of available chlorine.

A chlorine scavengers is preferably selected from the group consisting of:

a. amines and their salts;
b. ammonium salts;
c. amino acids and their salts;
d. polyamino acids and their salts;
e. polyethyleneimines and their salts;
f. polyamines and their salts;
g. polyamineamides and their salts;
h. polyacrylamides; and
i. mixtures thereof.

Non-limiting examples of chlorine scavengers include amines, preferably primary and secondary amines, including primary and secondary fatty amines, and alkanolamines; and their salts; ammonium salts, e.g., chloride, bromide, citrate, sulfate; amine-functional polymers and their salts; amino acid homopolymers with amino groups and their salts, such as polyarginine, polylysine, polyhistidine; amino acid copolymers with amino groups and their salts, including 1,5-di-ammonium-2-methyl-panthene dichloride and lysine monohydrochloride; amino acids and their salts, preferably those having more than one amino group per molecule, such as arginine, histidine, and lysine, reducing anions such as sulfite, bisulfite, thiosulfate, nitrite, and antioxidants such as ascorbate, carbamate, phenols; and mixtures thereof.

Preferred chlorine scavengers are water soluble, especially, low molecular weight primary and secondary amines of low volatility, e.g., monoethanolamine, diethanolamine, tris(hydroxymethyl) aminomethane, hexamethylenetetramine, tetramethyl dipropylenetriamine and their salts, and mixtures thereof. Suitable chlorine scavenger polymers include: water soluble amine-functional polymers, e.g., polyethyleneimines, polyamines, polyamineamides, polyacrylamides, and their salts, and mixtures thereof. The preferred polymers are polyethyleneimines, the polyamines, including di(higher alkyl)cyclic amines and their condensation products, polyamineamides, and their salts, and mixtures thereof. Preferred polymers for use in the fabric care compositions of the present invention are polyethyleneimines and their salts. Preferred polyethyleneimines have a molecular weight of less than about 2000, more preferably from about 200 to about 1500. The water solubility is preferably at least about 1 g/100 g water, more preferably at least about 3 g/100 g water, even more preferably at least about 5 g/100 g water.

Some polyamines with the general formula $(R^1)_2N(CX_2)_nN(R^2)_2$ can serve both as a chlorine scavenger and a "chelant" color care agent. Non-limiting examples of such preferred polyamines are N,N,N',N'-tetrakis(2-hydroxypropyl) ethylenediamine and N,N,N',N",N"-penta (2-hydroxypropyl) diethylenetriamine. Other suitable dual agents of this type are disclosed herein after in the Chelants section.

It is preferred that the chlorine scavenging amine-functional materials be neutralized by an acid, before they are added into the compositions. This neutralization actually converts the amines into ammonium salts. In the salt form, even simple amines and ammonia ($NH_3$) can be used. Preferred salts of this kind are the ammonium salts such as $NH_4Cl$, $(NH_4)_2SO_4$, and the like. Preferred polymeric chlorine scavengers have an average molecular weight of less than about 5,000, more preferably from about 200 to about 2,000, even more preferably from about 200 to about 1,000. Low molecular weight polymers are easier to remove from fabrics, resulting in less buildup of the chlorine scavenger and therefore less discoloration of the fabrics. The above chlorine scavenger is also suitable for use mixtures containing liquid fabric care actives with many of the preferred chlorine scavengers being at least partially water soluble.

2. Dye Transfer Inhibitors

Dye transfer inhibitors (DTI), such as polyvinyl pyrrolidone (PVP), appear to solubilize into the rinse and/or wash water to scavenge the free dye molecules, thus suspending the dyes and preventing them from redepositing onto fabrics. DTI may interact with some detergent actives and thus, it is preferable to provide DTI by adding them to the rinse bath solution, thus minimizing the interaction with surfactants.

The compositions of the present invention may contain an effective amount of polymeric dye transfer inhibiting agent (dye transfer inhibitor or DTI). An effective amount is typically an amount of DTI which will provide at least about 0.1 ppm, preferably from about 0.1 ppm to about 100 ppm, more preferably from about 0.2 ppm to about 20 ppm, in the subsequent wash or rinse liquor.

Suitable polymer DTIs are disclosed in WO 94/11482, published May 26, 1994, which is the same as copending, U.S. patent application of Trinh , et al., Ser. No. 08/209,694, filed Mar. 10, 1994, for FABRIC SOFTENING COMPOSITIONS WITH DYE TRANSFER INHIBITORS FOR IMPROVED FABRIC APPEARANCE.

As disclosed in said application, dye transfer inhibitors useful in the present invention include water-soluble polymers containing nitrogen and oxygen atoms, selected from the group consisting of:

(1) polymers, which preferably are not enzymes, with one or more monomeric units containing at least one ═N—C(═O)— group;
(2) polymers with one or more monomeric units containing at least one N-oxide group;
(3) polymers containing both ═N—C(═O)— and N-oxide groups of (1) and (2); and
(4) mixtures thereof;

wherein the nitrogen of the ═N—C(═O)— group can be bonded to either one or two other atoms (i.e., can have two single bonds or one double bond).

Dye transfer inhibitors useful in the present invention include water-soluble polymers having the structure:

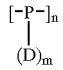

wherein each P is selected from homopolymerizable and copolymerizable moieties which attach to form the polymer backbone, preferably each P being selected from the group consisting of: vinyl moieties, e.g., $[—C(R)_2—C(R)_2—]$; other monomeric moieties, e.g., $—[[C(R)_2]_x$ -L-], wherein each x is an integer from about 1 to about 6 and each L is independently selected from the group consisting of: —N(R)—; —O—; —S—; —O—(O)C—; —C(O)—O—; —S(→O)—; —S(→O)$_2$—; —S(O)—O—; —O—(O)S—; —O—S(O)$_2$—O—; —O—[Si(R$_2$)—O]$_p$—; —C(O)—; and —O—C(O)—O—; and DTI-active groups —N(→O)(R)—; —N(R)C(O)—; —C(O)—N(R)— wherein each R is H, $C_{1-12}$ (preferably $C_{1-4}$) alkyl(ene), $C_6$–$C_{12}$ aryl(ene) and/or D, m is from 0 to 2, and p is from about 1 to about 6; wherein each D contains moieties selected from the group consisting of: L moieties; structural moieties selected from the group consisting of linear and cyclic $C_{1-12}$ (preferably $C_{1-4}$) alkyl; $C_{1-12}$ alkylene; $C_{1-12}$ heterocyclic groups, which can also contain the DTI active groups; aromatic $C_{6-12}$ groups; and R's to complete the group, wherein any linking groups which are attached to each other form linkages that are substantially stable under conditions of use; and wherein the nitrogen atoms can be attached to one, two, or three other atoms, the number of ═N—C(O)— and/or ≡—N→O groups present being sufficient to provide dye transfer inhibition, the total molecular weight being from about 500 to about 1,000,000, preferably from about 1,000 to about 500,000, n being selected to provide the indicated molecular weight, and the water solubility being at least about 100 ppm, preferably at least about 300 ppm, and more preferably at least about 1,000 ppm in water at ambient temperature of about 25° C.

a) Polymers with Active ═N—C(═O)— Groups

The most common polymer of this type is polyvinyl pyrrolidone (PVP). PVP is commercially available from ISP, Wayne, N.J., and BASF Corp., Parsippany, N.J., as a powder or aqueous solutions in several viscosity grades, designated as, e.g., K-12, K-15, K-25, and K-30. These K-values indicate the viscosity average molecular weight, as follows: PVP Viscosity Avg. Mol. Wt.=2,500 (K-12); 10,000 (K-15); 24,000 (K-25); and 40,000 (K-30). PVP K-12, K-15, and K-30 are also available from Polysciences, Inc. Warrington, Pa., and PVP K-15, K-25, and K-30 and poly(2-ethyl-2-oxazoline) are available from Aldrich Chemical Co., Inc., Milwaukee, Wis.

The average molecular weight for water-soluble polymers with ═N—C(═O)— groups useful in the present invention is from about 500 to about 100,000, preferably from about 500 to about 40,000, and more preferably from about 1,000 to about 30,000.

b) Polymers with Active N-Oxide Groups

Another useful group of polymeric DTI include water-soluble polymers containing active ≡N→O groups. The nitrogen of the ≡N→O group can be bonded to either one, two, or three other atoms.

One or more of the ≡N→O groups can be part of the pendant D group or one or more ≡N→O groups can be part of the polymerizable P unit or a combination of both.

Where the ≡N→O group is part of the pendant D group, preferred D groups contain cyclic structures with the nitrogen atom of the ≡N→O group being part of the ring or outside the ring. The ring in the D group may be saturated, unsaturated, or aromatic.

Examples of D groups containing the nitrogen atom of the ≡N→O group include N-oxides of heterocyclic compounds such as the N-oxides of pyridine, pyrrole, imidazole, pyrazole, pyrazine, pyrimidine, pyridazine, piperidine, pyrrolidone, azolidine, morpholine, and derivatives thereof. A preferred dye transfer inhibitor is poly(4-vinylpyridine N-oxide) (PVNO). Examples of D groups with the nitrogen atom of the ≡N→O group being outside the ring include aniline oxide and N-substituted aniline oxides.

An example of a polymer wherein the ≡N→O group is part of the monomeric P backbone group is polyethyleneimine N-oxide.

Mixtures of these groups can be present in the polymeric DTIs of (2) and (3).

The amine N-oxide polymers of the present invention typically have a ratio of amine N-oxide to the amine of from about 1:0 to about 1:2. The amount of amine oxide groups present in the polyamine oxide polymer can be varied by appropriate copolymerization or by appropriate degree of N-oxidation. Preferably, the ratio of amine N-oxide to amine is from about 1:0 to about 1:1, most preferred from about 1:0 to about 3:1.

The amine oxide unit of the polyamine N-oxides has a PKa of ≦10, preferably PKa ≦7, more preferably PKa ≦6.

The average molecular weight of (2) useful in the present invention is from about 500 to about 1,000,000; more preferably from about 1,000 to about 500,000; most preferably from about 2,000 to about 100,000.

Any polymer backbone above can be used in (1) or (2) as long as the polymer formed is water soluble and has dye transfer inhibiting properties. Examples of suitable polymeric backbones are polyvinyls, polyalkylenes, polyesters, polyethers, polyamide, polyimides, polyacrylates, and copolymers and block copolymers thereof, and mixtures thereof.

c) Copolymers Including Active =N—C(=O)— and/or ≡N→O Groups

Effective polymeric DTI agents can include those formed by copolymerizing mixtures of monomeric, oligomeric, and/or polymeric units containing active =N—C(=O)— and/or active ≡N→O groups (e.g., copolymers and/or block copolymers of PVP and PVNO). Other suitable DTI copolymers include those in which an effective amount of monomeric, oligomeric, and/or polymeric units containing active =N—C(=O)— groups and/or active ≡N→O groups is copolymerized with "filler" monomeric, oligomeric, and/or polymeric units which do not contain active =N—C(=O)— or ≡N→O groups but which impart other desirable properties to the DTI copolymer, such as increased water solubility or enhanced fabric substantivity [e.g., block copolymer of PVP (≧about 60%) and polyvinylimidazole].

3. Dye Fixatives

Dye fixatives are similar to dye transfer inhibitors, but tend to be more water insoluble. They act primarily by inhibiting removal of the dye rather than intercepting it in the water phase and keeping it suspended like the dye transfer inhibitors.

Suitable dye fixatives are disclosed in U.S. Pat. No. 5,632,781, Shinichi, et al., issued May 27, 1997; U.S. Pat. No. 4,583,989, Toshio, et al., issued Apr. 22, 1986; U.S. Pat. No. 3,957,574, Edward, issued May 18, 1975; U.S. Pat. No. 3,957,427, Chambers, issued May 18, 1976; and U.S. Pat. No. 3,940,247, Derwin, et al., issued Feb. 24, 1976.

4. Chelants

The compositions may also comprise a "chelant" color care agent, preferably color care agent having the formula:

$$(R^1)_2N(CX_2)_nN(R^2)_2$$

wherein each X is selected from the group consisting of hydrogen (preferred), linear or branched, substituted or unsubstituted alkyl groups having from about 1 to about 10 (preferably about 1 or about 2) carbons atoms and substituted or unsubstituted aryl having at least about 6 carbon atoms (preferably from about 6 to about 22), and mixtures thereof; n is an integer from 1 to about 6, preferably 2 or 3; each $R^1$and $R^2$ is independently selected from the group consisting of hydrogen; alkyl; aryl; alkaryl; aralkyl; hydroxyalkyl; polyhydroxyalkyl; $C_{1-10}$, preferably $C_{2-3}$, alkyl groups substituted with one (preferred), or more (preferably 2 or 3) carboxylic acid or phosphonic acid groups, or salts thereof; polyalkylether having the formula $—((CH_2)_yO)_zR^3$ where each $R^3$ is hydrogen (preferred) or a linear, branched, substituted or unsubstituted alkyl chain having from about 1 to about 10 (preferably from about 1 to about 4) carbon atoms and where y is an integer from about 2 to about 10 (preferably, 2 or 3) and z is an integer from about 1 to about 30 (preferably from 2 to 5); the group $—C(O)R^4$ where each $R^4$ is selected from the alkyl; alkaryl; aralkyl; hydroxyalkyl; polyhydroxyalkyl, polyalkylether, and alkyl groups substituted with one (preferred), or more (preferably 2 or 3) carboxylic acid or phosphonic acid groups, or salts thereof as defined in $R^1$ and $R^2$; and $—CX_2CX_2N(R^5)_2$ with no more than one of $R^1$ and $R^2$ being $CX_2CX_2N(R^5)_2$ and wherein each $R^5$ is selected from the alkyl; alkaryl; aralkyl; hydroxyalkyl; polyhydroxyalkyl, polyalkylether, and alkyl groups substituted with one (preferred), or more (preferably 2 or 3) carboxylic acid or phosphonic acid groups, or salts thereof as defined in $R^1$ and $R^2$; and one $R^1$ and one $R^2$ can combine to form a cyclic compound.

The available alkyl groups include linear or branched, substituted or unsubstituted alkyl groups typically having from about 1 to about 22 carbon atoms, preferably from about 1 to about 10 carbon atoms. Most preferred alkyl groups include methyl, ethyl, propyl, isopropyl, and mixtures thereof. The available aryl groups include substituted or unsubstituted aryl groups typically having from about 6 to about 22 carbon atoms. Substitutions can include alkyl chains as earlier described thereby providing alkaryl or aralkyl groups having from about 6 to about 22 carbon atoms. Preferred aryl, aralkyl and alkaryl groups include phenyl, benzyl and mesityl. The available hydroxyalkyl and polyhydroxyalkyl groups include linear or branched, hydroxy substituted groups typically having from about 1 to about 22 carbon atoms. Preferred groups include hydroxymethyl, hydroxyethyl, 1-hydroxypropyl and 2-hydroxypropyl. The available polyalkoxy (polyalkylether) groups include those having the formula: $—((CH_2)_yO)_zR^3$ wherein the integer y typically ranges from about 2 to about 10 with 2 and 3 the most preferred; the group $—(CH_2)_y—$ can include both linear and branched chains; preferred groups include ethoxy and isopropoxy groups; the integer z typically ranges from about 1 to about 30 with lower levels of alkoxylation, preferably ethoxylation, being preferred; $R^3$ is typically hydrogen or an alkyl groups having about 1 to about 5 carbon atoms. The group $—C(O)R^4$ can also be employed where $R^4$ is alkyl; alkaryl; aralkyl; hydroxyalkyl; polyhydroxyalkyl, polyalkylether, carboxylic acid, alkyl dicarboxylic acid, phosphonic acid, alkyl phosphonic acid as defined above, and mixtures thereof.

Remaining $R^1$ and $R^2$ possibilities include linear or branched alkyl carboxylic acid groups and water soluble salts thereof having the general formula $—(CH_p(R^7)_q)_tC(O)O^{(-)}$-$M^{(+)}$ wherein t is an integer from about 1 to about 5, p is an integer from about 1 to about 3, p+q=2 and $M^{(+)}$ is a water soluble monovalent cation such as hydrogen, alkali metal, etc. As t typically ranges from about 1 to about 5, the total number of carbons typically does not exceed about 6 and $M^{(+)}$ is a water soluble cation such as alkali metal or other available groups such as ammonium or substituted ammonium. Also available are dicarboxylic acid groups, including the water soluble salts, which have from about 2 to about 5 carbons atoms, and linear, branched or polyfunctional substituted branched alkyldicarboxylic acids and water soluble salts thereof also having from about 2 to about 5 carbon atoms.

Preferred carboxylate chelants include ethylenediaminetetraacetic acid (EDTA), N-hydroxyethylethylenediaminetriacetic acid, nitrilotriacetic acid (NTA), ethylenediamine tetraproprionic acid, ethylenediamine-N,N'-diglutamic acid, 2-hydroxypropylenediamine-N,N'-disuccinic acid, triethylenetetraaminehexaacetic acid, diethylenetriaminepentaacetic acid (DETPA), and ethanoldiglycines, including their water-soluble salts such as the alkali metal, ammonium, and substituted ammonium salts thereof, and mixtures thereof Phosphonic acid chelants and water soluble salts thereof and linear, branched or polyfunctional substituted branched alkylphosphonic acids and water soluble salts thereof can be employed as $R^1$ and $R^2$. In both cases, the number of carbon atoms typically ranges from about 1 to about 5. Preferred groups include ethylenediaminetetrakis (methylenephosphonic acid), diethylenetriamine-N,N,N',N",N"-pentakis (methane phosphonic acid) (DETMP) and 1-hydroxyethane-1,1-diphosphonic acid (HEDP), including their water-soluble salts such as the alkali metal, ammonium, and substituted ammonium salts thereof, and mixtures thereof.

$R^1$ and $R^2$ can also be the group $CX_2CX_2N(R^5)_2$. However, when the group is present, no more than one of $R^1$ and $R^2$ at any one time can be the group $CX_2CX_2N(R^5)_2$. Furthermore, each $R^5$ can be alkyl; alkaryl; aralkyl; hydroxyalkyl; polyhydroxyalkyl, polyalkylether, alkoxy, polyalkoxy alkyl carboxylic acid, alkyl dicarboxylic acid, phosphonic acid and alkyl phosphonic acid as defined above for $R^1$ and $R^2$. Preferably, when any one of $R^1$ and $R^2$ is present as the group $CX_2CX_2N(R^5)_2$, then each $R^5$ is preferably, alkyl or hydroxyalkyl group as defined above. Additionally, either of $R^1$ and of $R^2$ can combine to form a cyclic substituent. Suitable examples include the moiety:

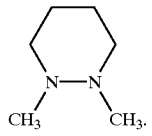

To provide suitable color care properties, the preferred color care chelants consist of at least about 3% by weight of the compound of nitrogen, preferably at least about 7% and more preferably at least about 9%. The preferred color care chelants have a total number of carbon atoms in the groups $R^1$ and $R^2$ of about 50 or less, more preferably of about 40 or less and more preferably of about 20 or less.

Most preferably, each $R^1$ and $R^2$ is independently selected from the group consisting of hydrogen, linear alkyl groups having from about 1 to about 5 carbon atoms and linear hydroxyalkyl groups having from about 1 to about 5 carbon atoms. Especially preferred are the groups ethyl, methyl, hydroxyethyl, hydroxypropyl, and mixtures thereof. While each of $R^1$ and $R^2$ can be individually selected, the preferred color care component according to the present invention involves the situation wherein each of $R^1$ and $R^2$ is hydroxyalkyl group having from about 1 to about 5 carbon atoms. A preferred list of chelants includes N,N,N',N'-tetraethylethylenediamine, 2-{[2-(dimethylamino)ethyl]-methylamino}ethanol, bis-(2-hydroxyethyl)N,N'-dimethylethylenediamine, bis(octyl)-N,N'-dimethylethylenediamine, N,N,N'N'-tetrakis(2-hydroxypropyl) ethylenediamine, N,N,N',N",N"-penta(2-hydroxypropyl)diethlyenetriamine, N,N'-diethylethyldiamine, N,N,N'-trimethylethylenediamine, 1,3-pentadiamine, N,N-dimethylethylenediamine, 2-(2-aminoethylamino)ethanol, N,N'-dimethylethylenediamine, 1,3-diamino-2-hydroxypropane, N'-methyl-2,2'-diaminodiethylamine, N-(2-aminoethyl)-1,3-propanediamine. Particularly preferred are N,N,N',N'-tetrakis(2-hydroxypropyl) ethylenediamine and N,N,N',N", N"-penta(2-hydroxypropyl)diethylenetriamine. Such materials are commercially available from a number of sources including BASF of Washington, N.J. under the tradename QUADROL and PENTROL.

These compounds are believed to provide protection as chelants and are preferred. However, other chelants can also be used, so long as they are compatible and can bind with metals that cause hue shifts in fabric dyes. Other suitable chelants are described in the copending allowed U.S. patent application of Rusche, et al., Ser. No. 08/753,167, filed Nov. 25, 1996, for CHELATING AGENTS FOR IMPROVED COLOR FIDELITY.

These chelants (which as used herein also includes materials effective not only for binding metals in solution but also those effective for precipitating metals from solution) include citric acid, citrate salts (e.g., trisodium citrate), isopropyl citrate, 1-hydroxyethylidene-1,1-diphosphonic acid (etidronic acid), available from Monsanto as Dequest RTM 2010, 4,5-dihydroxy-m-benzene-sulfonic acid/sodium salt, available from Kodak as Tiron RTM, diethylenetriaminepentaacetic acid, available from Aldrich, ethylene diaminetetraacetic acid (EDTA), ethylene diamine-N,N'-disuccinic acid (EDDS, preferably the S, S isomer), 8-hydroxyquinoline, sodium dithiocarbamate, sodium tetraphenylboron, ammonium nitrosophenyl hydroxylamine, and mixtures thereof. Most preferred of these chelants are EDTA and especially citric acid and citrate salts.

The compositions and articles herein may contain one or more iron and/or manganese chelating agents. Such chelating agents can be selected from the group consisting of amino carboxylates, amino phosphonates, polyfunctionally-substituted aromatic chelating agents and mixtures thereof, all as hereinafter defined. Without intending to be bound by theory, it is believed that the benefit of these materials is due in part to their exceptional ability to remove iron and manganese ions from washing solutions by formation of soluble chelates. In some cases, a conventional chelant in the laundry wash product may function in part to "regenerate" the fabric substantive chelants. This is accomplished when the heavy metal chelant, while remaining adsorbed to the fabric surface, exchanges any presently bound heavy metal ion to a conventional chelant. The metal exchanged is carried away with the conventional metal chelant, while the heavy metal chelant is substantively held on the fabric, free to chelate a new metal ion (i.e., in a subsequent rinse cycle).

Amino phosphonates are also suitable for use as chelating agents in the compositions of the invention when at least low levels of total phosphorus are permitted in detergent compositions, and include ethylenediaminetetrakis (methylenephosphonates) as DEQUEST. Preferred, these amino phosphonates to not contain alkyl or alkenyl groups with more than about 6 carbon atoms.

Polyfunctionally-substituted aromatic chelating agents are also useful in the compositions herein, as described in U.S. Pat. No. 3,812,044, issued May 21, 1974, to Connor, et al. Preferred compounds of this type in acid form are dihydroxydisulfobenzenes such as 1,2-dihydroxy-3,5-disulfobenzene.

The compositions of the present invention may contain one or more chelants in an amount between about 0.0001% and about 3% and preferably between about 0.0001% and about 2.0% by weight of the composition. A preferred biodegradable chelator for use herein is ethylenediamine disuccinate ("EDDS"), especially the [S,S] isomer, as described in U.S. Pat. No. 4,704,233, Nov. 3, 1987, to Hartman and Perkins.

Anti-Abrasion, Anti-Wear & Fabric Integrity Agents

The compositions of the present invention may further comprise one or more anti-abrasion, anti-wear and/or fabric integrity agents that are preferably a fabric abrasion reducing polymer as described below. Such agents may be present in the compositions at a level between about 0.05% and about 15% and preferably between about 0.1% and about 10.0% by weight of the composition.

1. Fabric Abrasion Reducing Polymers

The preferred reduced abrasion polymers of the present invention are water-soluble polymers having the formula:

$$[—P(D)_m-]_n$$

wherein the unit P is a polymer backbone which comprises units which are homopolymeric or copolymeric. D units are defined herein below. The term "homopolymeric" is defined as "a polymer backbone which is comprised of units having the same unit composition, i.e., formed from polymerization of the same monomer. The term "copolymeric" is defined as "a polymer backbone which is comprised of units having a different unit composition, i.e., formed from the polymerization of two or more monomers".

P backbones preferably comprise units having the formula:

$$—[CR_2—CR_2]— \text{ or } —[(CR_2)_x\text{-}L]-$$

wherein each R unit is independently hydrogen, $C_1$–$C_{12}$ alkyl, $C_6$–$C_{12}$ aryl, and D units as described herein below; preferably $C_1$–$C_4$ alkyl.

Each L unit is independently selected from heteroatom-containing moieties, non-limiting examples of which are selected from the group consisting of:

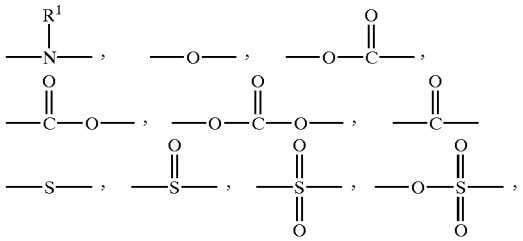

-continued

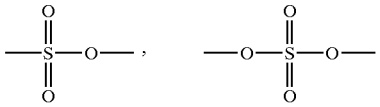

polysiloxane having the repeating unit:

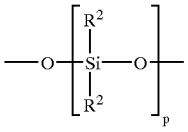

wherein p is an integer from 1 to about 50,000, and which has dye transfer inhibition activity:

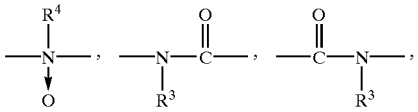

and mixtures thereof; wherein $R^1$ is hydrogen, $C_1$–$C_{12}$ alkyl, $C_8$–$C_{12}$ aryl, and mixtures thereof. $R^2$ is $C_1$–$C_{12}$ alkyl, $C_1$–$C_{12}$ alkoxy, $C_8$–$C_{12}$ aryloxy, and mixtures thereof; preferably methyl and methoxy. $R^3$ is hydrogen $C_1$–$C_{12}$ alkyl, $C_6$–$C_{12}$ aryl, and mixtures thereof; preferably hydrogen or $C_1$–$C_4$ alkyl, more preferably hydrogen. $R^4$ is $C_1$–$C_{12}$ alkyl, $C_6$–$C_{12}$ aryl, and mixtures thereof.

The backbones of the fabric abrasion reducing polymers useful in the present invention comprise one or more D units that comprise one or more units which provide a dye transfer inhibiting benefit. The D unit can be part of the backbone itself as represented in the general formula:

$$[—P(D)_m-]_n$$

or the D unit may be incorporated into the backbone as a pendant group to a backbone unit having, for example, the formula:

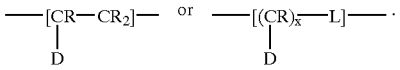

However, the number of D units depends upon the formulation. For example, the number of D units will be adjusted to provide water solubility of the polymer as well as efficacy of dye transfer inhibition while providing a polymer which has fabric abrasion reducing properties. The molecular weight of the fabric abrasion reducing polymers of the present invention are from about 500, preferably from about 1,000, more preferably from about 100,000 most preferably from about 160,000 to about 6,000,000, preferably to about 2,000,000, more preferably to about 1,000,000, yet more preferably to about 500,000, most preferably to about 360,000 daltons. Therefore the value of the index n is selected to provide the indicated molecular weight, and providing for a water solubility of least about 100 ppm, preferably at least about 300 ppm, and more preferably at least about 1,000 ppm in water at ambient temperature which is defined herein as about 25° C.

a) Polymers Comprising Amide Units

Non-limiting examples of preferred D units are D units which comprise an amide moiety. Examples of polymers wherein an amide unit is introduced into the polymer via a pendant group includes polyvinylpyrrolidone having the formula:

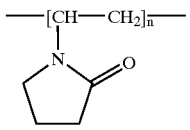

polyvinyloxazolidone having the formula:

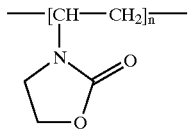

polyvinylmethyloxazolidone having the formula:

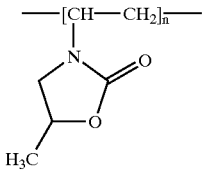

polyacrylamides and N-substituted polyacrylamides having the formula:

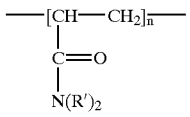

wherein each R' is independently hydrogen, $C_1$–$C_6$ alkyl, or both R' units can be taken together to form a ring comprising 4–6 carbon atoms; polymethacrylamides and N-substituted polymethacrylamides having the general formula:

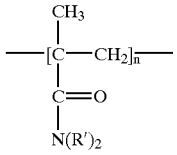

wherein each R' is independently hydrogen, $C_1$–$C_6$ alkyl, or both R' units can be taken together to form a ring comprising 4–6 carbon atoms; poly(N-acrylylglycinamide) having the formula:

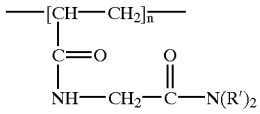

wherein each R' is independently hydrogen, $C_1$–$C_6$ alkyl, or both R' units can be taken together to form a ring comprising 4–6 carbon atoms; poly(N-methacrylylglycinamide) having the formula:

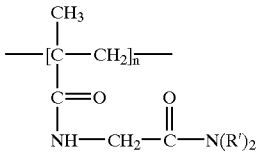

wherein each R' is independently hydrogen, $C_1$–$C_6$ alkyl, or both R' units can be taken together to form a ring comprising 4–6 carbon atoms; polyvinylurethanes having the formula:

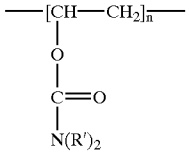

wherein each R' is independently hydrogen, $C_1$–$C_6$ alkyl, or both R' units can be taken together to form a ring comprising 4–6 carbon atoms.

An example of a D unit wherein the nitrogen of the dye transfer inhibiting moiety is incorporated into the polymer backbone is a poly(2-ethyl-2-oxazoline) having the formula:

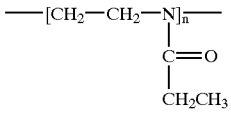

wherein the index n indicates the number of monomer residues present.

The fabric abrasion reducing polymers useful in the present invention can comprise any mixture of dye transfer inhibition units which provides the product with suitable properties. The preferred polymers which comprise D units which are amide moieties are those which have the nitrogen atoms of the amide unit highly substituted so the nitrogen atoms are in effect shielded to a varying degree by the surrounding non-polar groups. This provides the polymers with an amphiphilic character. Non-limiting examples include polyvinyl-pyrrolidones, polyvinyloxazolidones, N,N-disubstituted polyacrylamides, and N,N-disubstituted polymethacrylamides. A detailed description of physico-chemical properties of some of these polymers are given in "Water-Soluble Synthetic Polymers: Properties and Behavior", Philip Molyneux, Vol. I, CRC Press, (1983) included herein by reference.

The amide containing polymers may be present partially hydrolyzed and/or cross linked forms. A preferred polymeric compound for the present invention is polyvinylpyrrolidone (PVP). This polymer has an amphiphilic character with a highly polar amide group conferring hydrophilic and polar-attracting properties, and also has non-polar methylene and methine groups, in the backbone and/or the ring, conferring hydrophobic properties. The rings may also provide planar alignment with the aromatic rings in the dye molecules. PVP is readily soluble in aqueous and organic solvent systems. PVP is available ex ISP, Wayne, N.J., and BASF Corp., Parsippany, N.J., as a powder or aqueous solutions in several viscosity grades, designated as, e.g., K-12, K-15, K-25, and K-30. These K-values indicate the viscosity average molecular weight, as shown below:

| PVP viscosity average molecular weight (in thousands of daltons) | K-12 | K-15 | K-25 | K-30 | K-60 | K-90 |
|---|---|---|---|---|---|---|
| | 2.5 | 10 | 24 | 40 | 160 | 360 |

PVP K-12, K-15, and K-30 are also available ex Polysciences, Inc. Warrington, Pa., PVP K-15, K-25, and K-30 and poly(2-ethyl-2-oxazoline) are available ex Aldrich Chemical Co., Inc., Milwaukee, Wis. PVP K30 (40,000) through to K90 (360,000) are also commercially available ex BASF under the tradename Luviskol or commercially available ex ISP. Still higher molecular PVP like PVP 1.3MM, commercially available ex Aldrich is also suitable for use herein. Yet further PVP-type of material suitable for use in the present invention are polyvinylpyrrolidone-co-dimethylaminoethylmethacrylate, commercially available commercially ex ISP in a quaternised form under the tradename Gafquat® or commercially available ex Aldrich Chemical Co. having a molecular weight of approximately 1.0MM; polyvinylpyrrolidone-co-vinyl acetate, available ex BASF under the tradename Luviskol®, available in vinylpyrrolidone:vinylacetate ratios of from 3:7 to 7:3.

b) Polymers Comprising N-oxide Units

Another D unit which provides dye transfer inhibition enhancement to the fabric abrasion reducing polymers described herein, are N-oxide units having the formula:

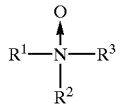

wherein $R^1$, $R^2$, and $R^3$ can be any hydrocarbyl unit (for the purposes of the present invention the term "hydrocarbyl" does not include hydrogen atom alone). The N-oxide unit may be part of a polymer, such as a polyamine, i.e., polyalkyleneamine backbone, or the N-oxide may be part of a pendant group attached to the polymer backbone. An example of a polymer which comprises an the N-oxide unit as a part of the polymer backbone is polyethyleneimine N-oxide. Non-limiting examples of groups which can comprise an N-oxide moiety include the N-oxides of certain heterocycles inter alia pyridine, pyrrole, imidazole, pyrazole, pyrazine, pyrimidine, pyridazine, piperidine, pyrrolidine, pyrrolidone, azolidine, morpholine. A preferred polymer is poly(4-vinylpyridine N-oxide, PVNO). In addition, the N-oxide unit may be pendant to the ring, for example, aniline oxide.

N-oxide comprising polymers will preferably have a ration of N-oxidized amine nitrogen to non-oxidized amine nitrogen of from about 1:0 to about 1:2, preferably to about 1:1, more preferably to about 3:1. The amount of N-oxide units can be adjusted by the formulator. For example, the formulator may co-polymerize N-oxide comprising monomers with non N-oxide comprising monomers to arrive at the desired ratio of N-oxide to non N-oxide amino units, or the formulator may control the oxidation level of the polymer during preparation. The amine oxide unit of the polyamine N-oxides of the present invention have a $Pk_a$ less than or equal to 10, preferably less than or equal to 7, more preferably less than or equal to 6. The average molecular weight of the N-oxide comprising polymers which provide a dye transfer inhibitor benefit to reduced fabric abrasion polymers is from about 500 daltons, preferably from about 100,000 daltons, more preferably from about 160,000 daltons to about 6,000,000 daltons, preferably to about 2,000,000 daltons, more preferably to about 360,000 daltons.

c) Polymers Comprising Amide Units and N-oxide Units

A further example of polymers which are fabric abrasion reducing polymers which have dye transfer inhibition benefits are polymers which comprise both amide units and N-oxide units as described herein above. Non-limiting examples include co-polymers of two monomers wherein the first monomer comprises an amide unit and the second monomer comprises an N-oxide unit. In addition, oligomers or block polymers comprising these units can be taken together to form the mixed amide/N-oxide polymers. However, the resulting polymers must retain the water solubility requirements described herein above.

Ultra-violet Protection A gents

The incorporation of sunscreens and antioxidants into a wash or rinse bath solution for various benefits is also known in the art. For example, U.S. Pat. No. 4,900,469, teaches antioxidants in detergent solutions for bleach stability. Antioxidants have likewise been used in softeners and detergents to prevent fabric yellowing and to control malodor. (See, JP 72/116,783, Kao.) JP 63/162,798, teaches the use of sunscreens to stabilize the color of fabric conditioning compositions. U.S. Pat. No. 5,134,223, Langer, et al., issued Jul. 28, 1992, teaches copolymers with a UV-absorbing monomer and a hydrophilic monomer to provide both anti-fading and soil release benefits. More specifically, this reference teaches the combination of a polymer of UV-absorbing monomers to a soil release polymer consisting of a hydrophilic group (e.g. ethoxylate) and hydrophobic group (e.g. terephthalate blocks). U.S. Pat. No. 5,250,652, Langer, et al., issued Oct. 5, 1993, teaches copolymers containing at least one UVA light-absorbing moiety and/or one UVB light-absorbing moiety, one low molecular weight (i.e., monomeric) hydrophilic moiety, and optionally one hydrophobic moiety for fabric care (detergents, fabric softeners, etc.) and skin care applications (cosmetics, shampoos, sunscreens, personal cleansing compositions, etc.). The use of low molecular weight hydrophilic moieties allows a loading of UVA and/or UVB moieties of up to about 95% and provides better dispersibility of the polymer in an aqueous media. The optional hydrophobic moiety provides control over the deposition of the copolymer on a desired surface.

UV protection agents may be used in the compositions of the present invention in an amount between about 0.001 to about 7.5% and preferably between about 0.001% to about 5.0% by weight of the composition.

1. Antioxidants

An antioxidant that may be used in the compositions and articles of the present invention is a non-fabric staining, light stable antioxidant compound preferably containing at least one $C_8$–$C_{22}$ hydrocarbon fatty organic moiety, preferably at least one $C_{12}$–$C_{18}$ hydrocarbon fatty organic moiety, wherein the antioxidant compound is a solid having a melting point of less than about 80° C., preferably less than about 50° C., or a liquid at a temperature of less than about 40° C., preferably from about 0° C. to about 25° C.

Preferred antioxidant compounds include:

(I)

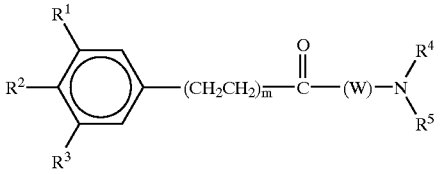

(II)

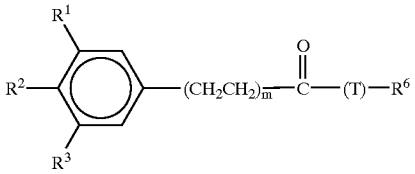

(III)

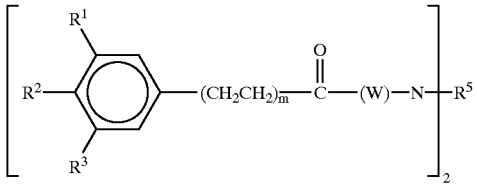

(IV)

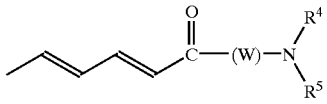

(V)

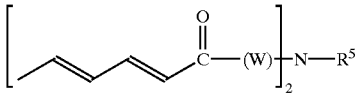

(VI)

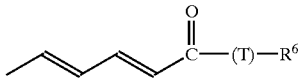

and mixtures thereof (VII);

wherein each $R^1$ and $R^3$ are the same or different moiety selected from the group consisting of hydroxy, $C_1$ to $C_6$ alkoxy groups (i.e., methoxy, ethoxy, propoxy, butoxy groups), branched or straight chained $C_1$ to $C_6$ alkyl groups, and mixtures thereof, preferably branched $C_1$ to $C_6$ alkyl groups, more preferably "tert"-butyl groups;

each $R^2$ is a hydroxy group;

each $R^4$ is a saturated or unsaturated $C_1$ to $C_{22}$ alkyl group or hydrogen, preferably a methyl group;

each $R^5$ is a saturated or unsaturated $C_1$ to $C_{22}$ alkyl group which can contain one or more ethoxylate or propoxylate groups, preferably a saturated or unsaturated $C_8$ to $C_{22}$ alkyl group, more preferably a saturated or unsaturated $C_{12}$ to $C_{18}$ alkyl group, and even more preferably a saturated or unsaturated $C_{12}$ to $C_{14}$ alkyl group;

each $R^6$ is a branched or straight chained, saturated or unsaturated, $C_8$ to $C_{22}$ alkyl group, preferably a branched or straight chained, saturated or unsaturated $C_{12}$ to $C_{18}$ alkyl group, more preferably a branched or straight chained, saturated or unsaturated $C_{16}$ to $C_{18}$ alkyl group;

each T is

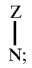

each W is

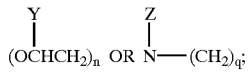

wherein Y is a hydrogen, a $C_1$ to $C_5$ alkyl group, preferably hydrogen or a methyl group, more preferably hydrogen;

wherein Z is hydrogen, a $C_1$ to $C_3$ alkyl group (which can be interrupted by an ester, amide, or ether group), a $C_1$ to $C_{30}$ alkoxy group (which can be interrupted by an ester, amide, or ether group), preferably hydrogen or a $C_1$ to $C_6$ alkyl group;

each m is from 0 to 4, preferably from 0 to 2;

each n is from 1 to 50, preferably from 1 to 10, more preferably 1; and each q is from 1 to 10, preferably from 2 to 6.

The antioxidants of the present invention can also comprise quaternary ammonium salts of Formulas I, III, IV and V, although amines of Formulas I, III, IV and V are preferred.

The antioxidant compounds of the present invention preferably comprise amine compounds of Formulas I, II, III, and mixtures thereof.

A preferred compound of Formula (II) is Octadecyl 3,5-di-tert-butyl-4-hydroxyhydro-cinnamate, known under the trade name of Irganox® 1076 available from Ciba-Geigy Co.

A preferred compound of formula (III) is N,N-bis[ethyl 3',5'-di-tert-butyl-4'-hydroxybenzoate] N-cocoamine.

The preferred antioxidants for use in the compositions of the present invention include 2-(N-methyl-N-coco-amino) ethyl 3',5'-di-tert-butyl-4'-hydroxybenzoate; 2-(N,N-dimethylamino)ethyl 3',5'-di-tert-butyl-4'-hydroxybenzoate; 2-(N-methyl-N-coco-amino)ethyl 3',4',5'-trihydroxybenzoate; and mixtures thereof, more preferably 2-(N-methyl-N-coco-amino)ethyl 3',5'-di-tert-butyl-4'-hydroxybenzoate. Of these compounds, the butylated compounds are preferred because the non-butylated compounds have a tendency to discolor in the composition of the present invention.

The antioxidant compounds to be used in the present invention demonstrate light stability in the compositions and articles. "Light stable" means that the antioxidant compounds in the compositions of the present invention do not discolor when exposed to either sunlight or simulated sunlight for approximately 2 to 60 hours at a temperature of from about 25° C. to about 45° C.

Descriptions of suitable antioxidants for use herein are provided in U.S. Pat. Nos. 5,543,083, 5,705,474, 5,723,435, 5,763,387, and 5,854,200, all of which are incorporated herein by reference.

2. Sunscreen Actives

The present invention may optionally include unitized dosing of a sunscreen compound that absorbs light at a wavelength of from about 290 nm to about 450 nm and more preferably from about 315 nm to about 400 nm. The sunscreen compound is a solid having a melting point of from about 25° C. to about 90° C., and more preferably from about 25° C. to about 75° C., and even more preferably from about 25° C. to about 50° C., or a viscous liquid at a temperature of less than about 40° C. and preferably between about 0° C. and about 25° C. Preferably, the sunscreen compound comprises at least one $C_8$ to $C_{22}$ hydrocarbon fatty organic moiety, more preferably at least one $C_{12}$ to $C_{18}$ hydrocarbon fatty organic moiety.

These sunscreen compounds preferably contain at least one of the following chromophores:

(I)

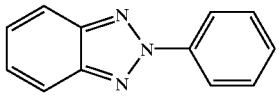

Phenylbenzotriazole (II)

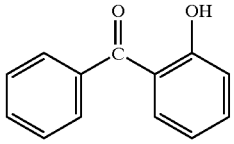

2-Hydroxybenzophenone (III)

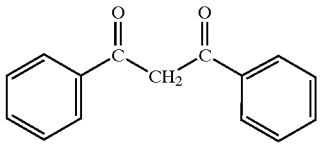

Dibenzoylmethane (IV)

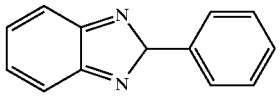

Phenylbenzimidazole (V)

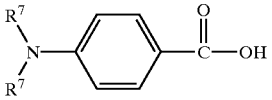

Esters of P-Aminobenzoic Acid (PABA)

(VI)

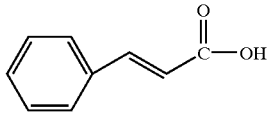

Esters of Cinnamic Acid (VII)

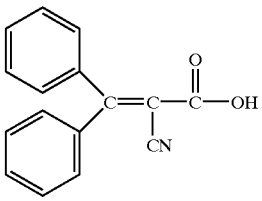

Esters of 2-Cyano-3, 3-Diphenyl-2-Propenoic Acid (VIII)

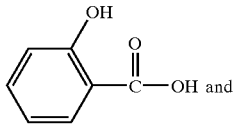

Esters of Salicylic Acid (IX)

mixtures thereof;

wherein $R^7$ is a hydrogen, methyl, ethyl, $C_1$ to $C_{22}$ branched or straight chain alkyl group; and mixtures thereof, preferably a methyl group; and wherein the compound containing the chromophore is a non-fabric staining, light stable compound containing preferably at least one $C_8$–$C_{22}$ hydrocarbon fatty organic moiety; wherein the chromophore absorbs light at a wavelength of from about 290 nm to about 450 nm; wherein the compound is a solid having a melting point of from about 25° C. to about 90° C. or a viscous liquid at a temperature of less than about 40° C.

Most preferably, the sunscreen compound is selected from the group consisting of:

(I)

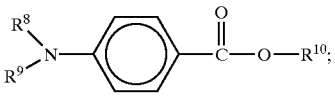

(II)

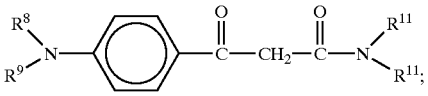

(III)

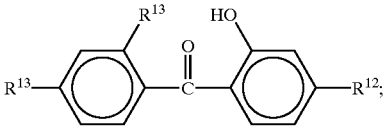

(IV)

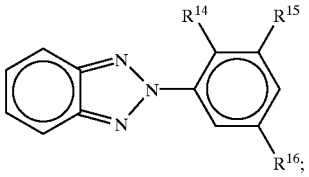

(V)

mixtures thereof;

wherein each $R^8$ is a hydrogen or a $C_1$–$C_{22}$ alkyl group; preferably a hydrogen or a methyl group;

each $R^9$ is a hydrogen, or a $C_1$–$C_{22}$ alkyl group; preferably a hydrogen or a methyl group;

each $R^{10}$ is a $C_1$–$C_{22}$ alkyl group, preferably a $C_8$–$C_{18}$ alkyl group; more preferably a $C_{12}$–$C_{18}$ alkyl group;

each $R^{11}$ is a hydrogen, a $C_1$–$C_{22}$ alkyl group and mixtures thereof, preferably a methyl group, a $C_8$–$C_{22}$ alkyl group, and mixtures thereof, more preferably, one $R^{11}$ group is a $C_{10}$–$C_{20}$ alkyl group, preferably a $C_{12}$–$C_{18}$ alkyl group, and the other $R^{11}$ group is a methyl group;

each $R^{12}$ is a hydrogen, hydroxy group, methoxy group, a $C_1$–$C_{22}$ alkyl group (which can be an ester, amide, or ether interrupted group) and mixtures thereof, preferably a $C_1$–$C_{22}$ alkyl group with an ether or ester interrupted group, and mixtures thereof, more preferably a methoxy group, a $C_8$–$C_{22}$ alkyl group with an ester interrupted group, and mixtures thereof;

each $R^{13}$ is a hydrogen, hydroxy group, a $C_1$–$C_{22}$ alkyl group (which can be an ester, amide, or ether interrupted group) and mixtures thereof, preferably a hydrogen, hydroxy group, and mixtures thereof, more preferably hydrogen;

each $R^{14}$ is a hydrogen, hydroxy group, or a $C_1$–$C_{22}$ alkyl group, preferably a hydrogen or a hydroxy group, more preferably a hydroxy group;

each $R^{15}$ is a hydrogen, hydroxy group, a $C_1$–$C_{22}$ alkyl group (which can be an ester, amide, or ether interrupted group), and mixtures thereof, preferably a $C_1$–$C_{12}$ alkyl group, more preferably a $C_1$–$C_8$ alkyl group, and even more preferably a methyl group, a "tert"-amyl group, or a dodecyl group;

each $R^{16}$ is a hydrogen, hydroxy group, or a $C_1$–$C_{22}$ alkyl group (which can be an ester, amide, or ether interrupted group), preferably a "tert"-amyl, a methyl phenyl group, or a coco dimethyl butanoate group.

However, $R^{12}$, $R^{13}$, $R^{14}$, $R^{15}$ and $R^{16}$ can be interrupted by the corresponding ester linkage interrupted group with a short alkylene ($C_1$–$C_4$) group.

Preferred sunscreen compounds for use in the compositions of the present invention are selected from the group consisting of fatty derivatives of PABA, benzophenones, cinnamic acid and phenyl benzotriazoles, specifically, octyl dimethyl PABA, dimethyl PABA lauryl ester, dimethyl PABA oleyl ester, benzophenone-3 coco acetate ether, benzophenone-3 available under the tradename Spectra-Sorb® UV-9 from Cyanamid, 2-(2'-Hydroxy-3',5'-di-tert-amylphenyl benzotriazole which is available under the tradename Tinuvin® 328 from Ceiba-Geigy, Tinuvin® coco ester 2-(2'Hydroxy, 3'-(coco dimethyl butanoate)-5'-methylphenyl) benzotriazole, and mixtures thereof. Preferred sunscreen compounds of the present invention are benzotriazole derivatives since these materials absorb broadly throughout the UV region. Preferred benzotriazole derivatives are selected from the group consisting of 2-(2'-Hydroxy, 3'dodecyl, 5'-methylphenyl benzotriazole from Ciba-Geigy, available under the tradename Tinuvin® 571 Coco 3-[3'-(2H-benzotriazol-2"-yl)-5'-tert-butyl-4'-hydroxyphenyl]propionate.

The sunscreen compounds of the present invention demonstrate light stability in the compositions of the present invention as defined above.

3. Mixtures of Antioxidant and Sunscreen Compounds

The present compositions and articles can comprise a mixture of antioxidant compounds and sunscreen compounds. Combinations of the sun-fade protection actives are particularly desirable because they address different mechanisms. Whereas the antioxidant compound protects dye degradation by preventing the generation of singlet oxygen and peroxy radicals and terminating degradation pathways; the sunscreen compound broadly absorbs UVA light in order to protect against sun-fade. The combination of these two mechanisms allows for broad sun-fade protection. When a mixture is present, the ratio of antioxidant to sunscreen is typically from about 1:10 to about 10:1, preferably from about 1:5 to about 5:1, and more preferably from about 1:2 to about 2:1.

Alternative Fabric Care Agents

The compositions of the present invention may also comprise fabric care agents or mixtures of agents including bodying agents, drape and form control agents, smoothness agents, static control agents, drying agents, stain resistance agents, soil release agents, anti-fading agents, whiteness enhancers, color appearance restoration agents, brightness restoration agents, defoamers, rinse aids, insect repellents, mite control agents, dyes, enzymes, and mixtures thereof.

It is further envisioned that the compositions of the present invention may contain one or more dyes for the purpose of rendering the separate phases visually distinct. In addition, it is envisioned that certain colors will be associated with certain fabric care benefits. For instance, a first color may be associated with fabric softening agents in one phase, and a second color associated with a color care agent in a second visually distinct phase. Further, within a product line of fabric softening compositions, one phase will have a first color to represent the presence of the fabric softening agent and a second differently colored second phase to represent the different fabric care agents in each of the compositions in that product line.

Other fabric care agents that are known in the art or which may become known may also be used to advantage in the multi-phase compositions of the present invention. The fact that fabric care agents and materials that will not form a uniform single phase composition may be used confirms that the fabric care agents described herein should not be considered limiting.

D. Optional Ingredients

Solvent

The compositions of the present invention may optionally contain a principal solvent in addition to the use of water. The principal solvents useful in compositions of the present invention are primarily used to obtain liquid compositions having sufficient clarity and viscosity. Principal solvents must also be selected to minimize solvent odor impact in the composition. The principal solvent is also selected for its ability to provide stable compositions at low temperatures, preferably compositions comprising a principal solvent is clear or transparent down to about 4° C. and has the ability to fully recover its clarity if stored as low as about 7° C. A principal solvent or mixture thereof may be used in the compositions of the present invention in an amount of between about 0.1% to about 40% and preferably between about 0.1% and about 30% by weight of the composition.

The principal solvent useful herein is selected based upon its octanol/water partition coefficient (P). The octanol/water partition coefficient is a measure of the ratio of the concentration of a particular principal solvent in octanol and water at equilibrium. The partition coefficients are conveniently expressed and reported as their logarithm to the base 10, i.e., to the logP.

The logP of many principal solvent species has been reported in, for example, the Pomona92 database, available from Daylight Chemical Information Systems, Inc. (Daylight CIS), along with citations to the original literature. However, the logP values are most conveniently calculated by the "CLOGP" program, also available from Daylight CIS. This program also lists experimental logP values when they are available in the Pomona92 database. The "calculated logP" (ClogP) may be determined by the fragment approach of Hansch and Leo (cf., A. Leo, in Comprehensive Medicinal Chemistry, Vol. 4, C. Hansch, P. G. Sammens, J. B. Taylor and C. A. Ransden, Eds., p. 295, Pergamon Press, 1990, incorporated herein by reference). The fragment approach is based on the chemical structure of each HR species, and takes into account the numbers and types of atoms, the atom connectivity, and chemical bonding. ClogP values are the most reliable and widely used estimates for octanol water partitioning. It will be understood by those skilled in the art that while experimental log P values could also be used, they represent a less preferred embodiment of the invention. Where experimental log P values are used, the one hour log P values are preferred. Other methods that may be used to compute ClogP include, e.g., Crippen's fragmentation method as disclosed in J. Chem. Inf. Comput. Sci., 27a, 21 (1987); Viswanadhan's fragmentation method as disclosed in J. Chem. Inf. Comput. Sci., 29, 163 (1989); and Broto's method as disclosed in Eur. J. Med. Chem.—Chim. Theor., 19, 71 (1984).

The principal solvent useful herein has a ClogP of from 0 to about 3, preferably from about 0.15 to about 1, more preferably from about 0.15 to about 0.64, even more preferably from about 0.25 to about 0.62, and yet even more preferably from about 0.4 to about 0.6 When used in combination with electrolyte, principal solvents with a ClogP in the range from about −2.0 to about 2.6 may be used.

A preferred principal solvent includes a mono-alcohol, a $C_6$ diol, a $C_7$ diol, octanediol, a butanediol derivative, trimethylpentanediol, ethylmethylpentanediol, propylpentanediol, dimethylhexanediol, ethylhexanediol, methylheptanediol, octanediol, nonanediol, an alkyl glyceryl ether, a di(hydroxy alkyl) ether, an aryl glyceryl ether, an alicyclic diol derivative, an alkoxylated $C_3$–$C_7$ diol derivative, an aryl diol, and a mixture thereof, as disclosed in WO 97/03169, entitled "Concentrated, Stable, Preferably Clear, Fabric Softening Composition". Isomers of the above principal solvents may also be used.

Nonlimiting examples of a preferred principal solvent includes 1,2-hexanediol, 2-ethyl-1,3-hexanediol, alcohol ethoxylates of 2-ethyl-1,3-hexanediol, 2,2,4-trimethyl-1,3-pentanediol, alcohol ethoxylates of 2,2,4-trimethyl-1,3-pentanediol, phenoxyethanol, 1,2-cyclohexanedimethanol, and a mixture thereof.

Electrolyte

The compositions of the present invention may optionally contain a low or a relatively high level of electrolyte, e.g. from 0% up, normally from about 0.05% to about 15%, preferably from about 0.1% to about 10%, and more preferably from about 0.2% to about 5%, by weight of the composition. In the compositions of the present invention, the electrolyte can help to induce the formation of visually distinct layers. Addition of electrolyte may lead to the formation of an aqueous bottom layer, while the top layer will consist of a clear/translucent formulation containing the fabric conditioning active in a so-called L3 or sponge phase (for a description of the L3 phase: See "Isotropic Bicontinuous solutions in surfactant-solvent systems: the L3 phase." D. Anderson, H. Wennerstrom and U. Olsson in the Journal of Physical Chemistry, 1989, 93, p. 4243 to 4253)

U.S. Pat. No. 5,759,990, incorporated herein by reference, discloses that the principal solvent in clear formulations should have a ClogP of from about 0.15 to about 0.64. A high electrolyte level allows the use of principal solvents with a ClogP of from about −2.0 to about 2.6, preferably from about −1.7 to about 1.6, and more preferably from about −1.0 to about 1.0. The principal solvents are also more effective with the high electrolyte level, thus allowing one to use less of such principal solvents.

Inorganic salts suitable for inducing layer formation include $MgI_2$, $MgBr_2$, $MgCl_2$, $Mg(NO_3)_2$, $Mg_3(PO_4)_2$, $Mg_2P_2O_7$, $MgSO_4$, magnesium silicate, NaI, NaBr, NaCl, NaF, $Na_3(PO_4)$, $NaSO_3$, $Na_2SO_4$, $Na_2SO_3$, $NaNO_3$, $NaIO_3$, $Na_3(PO_4)$, $Na_4P_2O_7$, sodium silicate, sodium metasilicate, sodium tetrachloroaluminate, sodium tripolyphosphate (STPP), $Na_2Si_3O_7$, sodium zirconate, $CaF_2$, $CaCl_2$, $CaBr_2$, $CaI_2$, $CaSO_4$, $Ca(NO_3)_2$, Ca, KI, KBr, KCl, KF, $KNO_3$, $KIO_3$, $K_2SO_4$, $K_2SO_3$, $K_3(PO_4)$, $K_4(P_2O_7)$, potassium pyrosulfate, potassium pyrosulfite, LiI, LiBr, LiCl, LiF, $LiNO_3$, $AlF_3$, $AlCl_3$, $AlBr_3$, $AlI_3$, $Al_2(SO_4)_3$, $Al_2(PO_4)_3$, $Al(NO_3)_3$, aluminum silicate; including hydrates of these salts and including combinations of these salts or salts with mixed cations e.g. potassium alum $AlK(SO_4)_2$ and salts with mixed anions, e.g. potassium tetrachloroaluminate and sodium tetrafluoroaluminate. Salts incorporating cations from groups IIIa, IVa, Va, VIa, VIIa, VIII, Ib, and IIb on the periodic chart with atomic numbers >13 are also useful in reducing dilution viscosity but less preferred due to their tendency to change oxidation states and adversely affect the odor or color of the formulation or lower weight efficiency. Salts with cations from group Ia or IIa with atomic numbers >20 as well as salts with cations from the lanthanide series are useful in reducing dilution viscosity, but less preferred due to lower weight efficiency or toxicity. Mixtures of the above salts are also useful.

Organic salts useful in this invention include, magnesium, sodium, lithium, potassium, zinc, and aluminum salts of the carboxylic acids including formate, acetate, proprionate, pelargonate, citrate, gluconate, lactate aromatic acids e.g. benzoates, phenolate and substituted benzoates or phenolates, such as phenolate, salicylate, polyaromatic acids terephthalates, and polyacids e.g. oxylate, adipate, succinate, benzenedicarboxylate, benzenetricarboxylate. Other useful organic salts include carbonate and/or hydrogencarbonate ($HCO_3^{-1}$) when the pH is suitable, alkyl and aromatic sulfates and sulfonates e.g. sodium methyl sulfate, benzene sulfonates and derivatives such as xylene sulfonate, and amino acids when the pH is suitable. Electrolytes can comprise mixed salts of the above, salts neutralized with mixed cations such as potassium/sodium tartrate, partially neutralized salts such as sodium hydrogen tartrate or potassium hydrogen phthalate, and salts comprising one cation with mixed anions.

Generally, inorganic electrolytes are preferred over organic electrolytes for better weight efficiency and lower costs. Mixtures of inorganic and organic salts can be used. Typical levels of electrolyte in the compositions are less than about 15%. Preferably from about 0.5% to about 10% by weight, more preferably from about 0.75% to about 2.5%, and most preferably from about 1% to about 5% by weight of the fabric softener composition.

Phase Modifier

Phase modifiers are highly desirable for formulating compositions of the present invention. It is believed that clear and translucent products are comprised of surfactants structured in bilayers with an aqueous domain between these bilayers. Oily materials, such as hydrophobic perfumes, can be incorporated within the bilayers between the surfactant tails. In fact, these oily materials can act to stabilize the bilayers if the amount present is not excessive. Water soluble compounds, such as the electrolytes described above, tend to stay in the aqueous domain between the bilayers.

It is believed that in cationic softener compositions with no or low electrolyte levels, the surfactant structure is normally stabilized by the electrostatic repulsion between the bilayers. The use of one or more phase stabilizers allows the formulator to control the amount of water retained in the L3 phase and is therefore useful to adjust the relative volumes of the different layers.

Typical levels of phase stabilizer in fabric softening compositions are from an effective amount up to about 15% by weight, preferably from about 0.1% to about 7% by weight, more preferably from about 1% to about 5% by weight of the composition. The phase stabilizer compounds described herein differ from the principal solvents described hereinbefore by their ability to provide steric repulsion at the interface. These phase stabilizers are not principal solvents as defined herein.

The phase stabilizers useful in the compositions of the present invention are selected surface active materials commonly comprised of hydrophobic and hydrophilic moieties. A preferred hydrophilic moiety is polyalkoxylated group, preferably polyethoxylated group. Preferred phase stabilizers are nonionic surfactants derived from saturated and/or unsaturated primary, secondary, and/or branched, amine, amide, amine-oxide fatty alcohol, fatty acid, alkyl phenol, and/or alkyl aryl carboxylic acid compounds, each preferably having from about 6 to about 22, more preferably from about 8 to about 18, carbon atoms in a hydrophobic chain, more preferably an alkyl or alkylene chain, wherein at least one active hydrogen of said compounds is ethoxylated with ≦50, preferably ≦30, more preferably from about 5 to about 15, and even more preferably from about 8 to about 12, ethylene oxide moieties to provide an HLB of from about 8 to about 20, preferably from about 10 to about 18, and more preferably from about 11 to about 15.

Suitable phase stabilizers also include nonionic surfactants with bulky head groups selected from:

a. surfactants having the formula $$R^1—C(O)—Y'—[C(R^5)]_m—CH_2O(R^2O)_zH$$

wherein $R^1$ is selected from the group consisting of saturated or unsaturated, primary, secondary or branched chain alkyl or alkyl-aryl hydrocarbons; said hydrocarbon chain having a length of from about 6 to about 22; Y' is selected from the following groups: —O—; —N(A)-; and mixtures thereof; and A is selected from the following groups: H; $R^1$; $—(R^2—O)_z—H$; $—(CH_2)_xCH_3$; phenyl, or substituted aryl, wherein $0 \leqq x \leqq$ about 3 and z is from about 5 to about 30; each $R^2$ is selected from the following groups or combinations of the following groups: $—(CH_2)_n—$ and/or $—[CH(CH_3)CH_2]—$; and each $R^5$ is selected from the following groups: —OH; and $—O(R^2O)_z—H$; and m is from about 2 to about 4;

b. surfactants having the formulas:

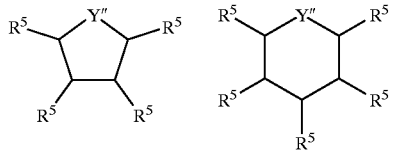

wherein Y"═N or O; and each $R^5$ is selected independently from the following:—H, —OH, $—(CH_2)xCH_3$, $—O(OR^2)_z—H$, $—OR^1$, $—OC(O)R^1$, and $—CH(CH_2—(OR^2)_{z''}—H)—CH_2—(OR^2)_{z'}—C(O)R^1$, x and $R^1$ are as defined above and $5 \leqq z, z', \text{and } z'' \leqq 20$, more preferably $5 \leqq z+z'+z'' \leqq 20$, and most preferably, the heterocyclic ring is a five member ring with Y"═O, one $R^5$ is —H, two $R^5$ are $—O—(R^2O)z-H$, and at least one $R^5$ is the following structure $—CH(CH_2—(OR^2)_{z''}—H)—CH_2—(OR^2)_{z'}—C(O)R^1$ with $8 \leqq z+z'+z'' \leqq 20$ and $R^1$ is a hydrocarbon with from 8 to 20 carbon atoms and no aryl group;

c. polyhydroxy fatty acid amide surfactants of the formula:

$$R^6—C(O)—N(R^7)—W$$

wherein: each $R^7$ is H, $C_1$–$C_4$ hydrocarbyl, $C_1$–$C_4$ alkoxyalkyl, or hydroxyalkyl, e.g., 2-hydroxyethyl, 2-hydroxypropyl, etc., preferably $C_1$–$C_4$ alkyl, more preferably $C_1$ or $C_2$ alkyl, most preferably $C_1$ alkyl (i.e., methyl) or methoxyalkyl; and $R^6$ is a $C_5$–$C_{31}$ hydrocarbyl moiety, preferably straight chain $C_7$–$C_{19}$ alkyl or alkenyl, more preferably straight chain $C_9$–$C_{17}$ alkyl or alkenyl, most preferably straight chain $C_{11}$–$C_{17}$ alkyl or alkenyl, or mixture thereof; and W is a polyhydroxyhydrocarbyl moiety having a linear hydrocarbyl chain with at least 3 hydroxyls directly connected to the chain, or an alkoxylated derivative (preferably ethoxylated or propoxylated) thereof. W preferably will be derived from a reducing sugar in a reductive amination reaction; more preferably W is a glycityl moiety. W preferably will be selected from the group consisting of $—CH_2—(CHOH)_n—CH_2OH$, $—CH(CH_2OH)—(CHOH)_n—CH_2OH$, $—CH_2—(CHOH)_2(CHOR')(CHOH)—CH_2OH$, where n is an integer from about 3 to about 5, inclusive, and R' is H or a cyclic mono- or poly-saccharide, and alkoxylated derivatives thereof. Most preferred are glycityls wherein n is 4, particularly $—CH_2—(CHOH)_4—CH_2O$. Mixtures of the above W moieties are desirable. $R^6$ can be, for example, N-methyl, N-ethyl, N-propyl, N-isopropyl, N-butyl, N-isobutyl, N-2-hydroxyethyl, N-1-methoxypropyl, or N-2-hydroxypropyl. $R^6—CO—N<$ can be, for example, cocamide, stearamide, oleamide, lauramide, myristamide, capricamide, palmitamide, tallowamide, etc. W can be 1-deoxyglucityl, 2-deoxyfructityl, 1-deoxymaltityl, 1-deoxylactityl, 1-deoxygalactityl, 1-deoxymannityl, 1-deoxymaltotriotityl, etc.

d. mixtures thereof.

Suitable phase stabilizers also include surfactant complexes formed by one surfactant ion being neutralized with surfactant ion of opposite charge or an electrolyte ion that is suitable for reducing dilution viscosity and block copolymer surfactants comprising polyethylene oxide moieties and propylene oxide moieties. Examples of representative phase stabilizers include:

(1)-Alkyl or Alkyl-aryl Alkoxylated Nonionic Surfactants

Suitable alkyl alkoxylated nonionic surfactants are generally derived from saturated or unsaturated primary, secondary, and branched fatty alcohols, fatty acids, alkyl phenols, or alkyl aryl (e.g., benzoic) carboxylic acid, where the active hydrogen(s) is alkoxylated with ≦ about 30 alkylene, preferably ethylene, oxide moieties (e.g. ethylene oxide and/or propylene oxide). These nonionic surfactants for use herein preferably have from about 6 to about 22 carbon atoms on the alkyl or alkenyl chain, and are in either straight chain or branched chain configuration, preferably straight chain configurations having from about 8 to about 18 carbon atoms, with the alkylene oxide being present, preferably at the primary position, in average amounts of ≦ about 30 moles of alkylene oxide per alkyl chain, more preferably from about 5 to about 15 moles of alkylene oxide, and most preferably from about 8 to about 12 moles of alkylene oxide. Preferred materials of this class also have pour points of about 70° F. and/or do not solidify in these clear formulations. Examples of alkyl alkoxylated surfactants with straight chains include Neodol® 91-8, 25-9, 1-9, 25-12, 1-9, and 45-13 from Shell, Plurafac® B-26 and C-17 from BASF, and Brij® 76 and 35 from ICI Surfactants. Examples of branched alkyl alkoxylated surfactants include Tergitol® 15-S-12, 15-S-15, and 15-S-20 from Union Carbide and Emulphogene® BC-720 and BC-840 from GAF. Examples of alkyl-aryl alkoxylated surfactants include Igepal® CO-620 and CO-710, from Rhone Poulenc, Triton® N-111 and N-150 from Union Carbide, Dowfax® 9N5 from Dow and Lutensol® AP9 and AP14, from BASF.

(2)-Alkyl or Alkyl-aryl Amine or Amine Oxide Nonionic Alkoxylated Surfactants Suitable alkyl alkoxylated nonionic surfactants with amine functionality are generally derived from saturated or unsaturated, primary, secondary, and branched fatty alcohols, fatty acids, fatty methyl esters, alkyl phenol, alkyl benzoates, and alkyl benzoic acids that are converted to amines, amine-oxides, and optionally substituted with a second alkyl or alkyl-aryl hydrocarbon with one or two alkylene oxide chains attached at the amine functionality each having ≦ about 50 moles alkylene oxide moieties (e.g. ethylene oxide and/or propylene oxide) per mole of amine. The amine, amide or amine-oxide surfactants for use herein have from about 6 to about 22 carbon atoms, and are in either straight chain or branched chain configuration, preferably there is one hydrocarbon in a straight chain configuration having about 8 to about 18 carbon atoms with one or two alkylene oxide chains attached to the amine moiety, in average amounts of ≦50 about moles of alkylene oxide per amine moiety, more preferably from about 5 to about 15 moles of alkylene oxide, and most preferably a single alkylene oxide chain on the amine moiety containing from about 8 to about 12 moles of alkylene oxide per amine moiety. Preferred materials of this class also have pour points about 70° F. and/or do not solidify in these clear formulations. Examples of ethoxylated amine surfactants include Berol® 397 and 303 from Rhone Poulenc and Ethomeens® C/20, C25, T/25, S/20, S/25 and Ethodumeens® T/20 and T25 from Akzo. Preferably, the compounds of the alkyl or alkyl-aryl alkoxylated surfactants and alkyl or alkyl-aryl amine, amide, and amine-oxide alkoxylated have the following general formula:

$$R^1m—Y—[(R^2—O)_z—H]_p$$

wherein each $R^1$ is selected from the group consisting of saturated or unsaturated, primary, secondary or branched chain alkyl or alkyl-aryl hydrocarbons; said hydrocarbon chain preferably having a length of from about 6 to about 22, more preferably from about 8 to about 18 carbon atoms, and even more preferably from about 8 to about 15 carbon atoms, preferably, linear and with no aryl moiety; wherein each $R^2$ is selected from the following groups or combinations of the following groups: $—(CH_2)_n—$ and/or $—[CH(CH_3)CH_2]—$; wherein about $1<n\leqq$ about 3; Y is selected from the following groups: —O—; $—N(A)_q$-; —C(O)O—; $—(O\leftarrow)N(A)_q$-; $—B—R^3—O—$; $—B—R^3—N(A)_q$-; $—B—R^3—C(O)O—$; $—B—R^3—N(\rightarrow O)(A)$-; and mixtures thereof; wherein A is selected from the following groups: H; $R^1$; $—(R^2—O)_z—H$; $—(CH_2)_xCH_3$; phenyl, or substituted aryl, wherein $0\leqq x\leqq$ about 3 and B is selected from the following groups: —O—; —N(A)-; —C(O)O—; and mixtures thereof in which A is as defined above; and wherein each $R^3$ is selected from the following groups: $R^2$; phenyl; or substituted aryl. The terminal hydrogen in each alkoxy chain can be replaced by a short chain $C_{1-4}$ alkyl or acyl group to "cap" the alkoxy chain. z is from about 5 to about 30. p is the number of ethoxylate chains, typically one or two, preferably one and m is the number of hydrophobic chains, typically one or two, preferably one and q is a number that completes the structure, usually one.

Preferred structures are those in which m=1, p=1 or 2, and $5\leqq z\leqq 30$, and q can be 1 or 0, but when p=2, q must be 0; more preferred are structures in which m=1, p=1 or 2, and $7\leqq z\leqq 20$; and even more preferred are structures in which m=1, p=1 or 2, and $9\leqq z\leqq 12$. The preferred y is 0.

(3) Alkoxylated and Non-alkoxylated Nonionic Surfactants with Bulky Head Groups Suitable alkoxylated and non-alkoxylated phase stabilizers with bulky head groups are generally derived from saturated or unsaturated, primary, secondary, and branched fatty alcohols, fatty acids, alkyl phenol, and alkyl benzoic acids that are derivatized with a carbohydrate group or heterocyclic head group. This structure can then be optionally substituted with more alkyl or alkyl-aryl alkoxylated or non-alkoxylated hydrocarbons. The heterocyclic or carbohydrate is alkoxylated with one or more alkylene oxide chains (e.g. ethylene oxide and/or propylene oxide) each having ≦ about 50, preferably ≦ about 30, moles per mole of heterocyclic or carbohydrate. The hydrocarbon groups on the carbohydrate or heterocyclic surfactant for use herein have from about 6 to about 22 carbon atoms, and are in either straight chain or branched chain configuration, preferably there is one hydrocarbon having from about 8 to about 18 carbon atoms with one or two alkylene oxide chains carbohydrate or heterocyclic moiety with each alkylene oxide chain present in average amounts of ≦ about 50, preferably ≦ about 30, moles of carbohydrate or heterocyclic moiety, more preferably from about 5 to about 15 moles of alkylene oxide per alkylene oxide chain, and most preferably between about 8 and about 12 moles of alkylene oxide total per surfactant molecule including alkylene oxide on both the hydrocarbon chain and on the heterocyclic or carbohydrate moiety. Examples of phase stabilizers in this class are Tween® 40, 60, and 80 available from ICI Surfactants.

(4)-Alkoxylated Cationic Quaternary Ammonium Surfactants

Alkoxylated cationic quaternary ammonium surfactants suitable for this invention are generally derived from fatty alcohols, fatty acids, fatty methyl esters, alkyl substituted phenols, alkyl substituted benzoic acids, and/or alkyl substituted benzoate esters, and/or fatty acids that are converted to amines which can optionally be further reacted with another long chain alkyl or alkyl-aryl group; this amine compound is then alkoxylated with one or two alkylene oxide chains each having ≦ about 50 moles alkylene oxide moieties (e.g. ethylene oxide and/or propylene oxide) per mole of amine. Typical of this class are products obtained from the quaternization of aliphatic saturated or unsaturated, primary, secondary, or branched amines having one or two hydrocarbon chains from about 6 to about 22 carbon atoms alkoxylated with one or two alkylene oxide chains on the amine atom each having less than ≦ about 50 alkylene oxide moieties. The amine hydrocarbons for use herein have from about 6 to about 22 carbon atoms, and are in either straight chain or branched chain configuration, preferably there is one alkyl hydrocarbon group in a straight chain configuration having about 8 to about 18 carbon atoms. Suitable quaternary ammonium surfactants are made with one or two alkylene oxide chains attached to the amine moiety, in average amounts of ≦ about 50 moles of alkylene oxide per alkyl chain, more preferably from about 3 to about 20 moles of alkylene oxide, and most preferably from about 5 to about 12 moles of alkylene oxide per hydrophobic, e.g., alkyl group. Preferred materials of this class also have a pour points below about 70° F. and/or do not solidify in these clear formulations. Examples of suitable phase stabilizers of this type include Ethoquad® 18/25, C/25, and O/25 from Akzo and Variquat®-66 (soft tallow alkyl bis(polyoxyethyl) ammonium ethyl sulfate with a total of about 16 ethoxy units) from Witco. Preferably, the compounds of the ammonium alkoxylated cationic surfactants have the following general formula:

$$\{R^1m—Y—[(R^2—O)_z—H]_p\}^+X^-$$

wherein $R^1$ and $R^2$ are as defined previously in section D above; Y is selected from the following groups: $=N^+$-$(A)_q$; $—(CH_2)_n—N^+$-$(A)_q$; $—B—(CH_2)_n—N^+$-$(A)_2$; —(phenyl)—$N^+$-$(A)_q$; —(B-phenyl)—$N^+$-$(A)_q$; with n being from about 1 to about 4. Each A is independently selected from the following groups: H; $R^1$; $—(R^2O)_z—H$; $—(CH_2)_xCH_3$; phenyl, and substituted aryl; where $0\leqq x\leqq$ about 3; and B is selected from the following groups: —O—; —NA-; $—NA_2$; —C(O)O—; and —C(O)N(A)-; wherein $R^2$ is defined as hereinbefore; q=1 or 2; and $X^-$ is an anion which is compatible with fabric softener actives and adjunct ingredients. Preferred structures are those in which m=1, p=1 or 2, and about $5 \leqq z \leqq$ about 50, more preferred are structures in which m=1, p=1 or 2, and about $7 \leqq z \leqq$ about 20, and most preferred are structures in which m=1, p=1 or 2, and about $9 \leqq z \leqq$ about 12.

(5)-Surfactant Complexes

Surfactant complexes are considered to be surfactant ions neutralized with a surfactant ion of opposite charge or a surfactant neutralized with an electrolyte that is suitable for reducing dilution viscosity, an ammonium salt, or a polycationic ammonium salt. For the purpose of this invention, if a surfactant complex is formed by surfactants of opposite charge, it is preferable that the surfactants have distinctly different chain lengths e.g. a long-chain surfactant complexed with a short-chain surfactant to enhance the solubility of the complex and it is more preferable that the that the long chain surfactant be the amine or ammonium containing surfactant. Long chain surfactants are defined as containing alkyl chains with from about 6 to about 22 carbon atoms. These alkyl chains can optionally contain a phenyl or substituted phenyl group or alkylene oxide moieties between the chain and the head group. Short chain surfactants are defined as containing alkyl chains with less than about 6 carbons and optionally these alkyl chains could contain a phenyl or substituted phenyl group or alkylene oxide moieties between the alkyl chain and the head group. Examples of suitable surfactant complexes include mixtures of Armeen® APA-10 and calcium xylene sulfonate, Armeen APA-10 and magnesium chloride, lauryl carboxylate and triethanol amine, linear alkyl benzene sulfonate and $C_5$-dimethyl amine, or alkyl ethoxylated sulfate and tetrakis N,N,N'N' (2-hydroxylpropyl) ethylenediamine. Preferably, long-chain surfactants for making complexes have the following general formula:

$$R^1—Y^2$$

wherein $R^1$ is as hereinbefore from section D above and $Y^2$ can be chosen from the following structures: $—N(A)_2$; $—C(O)N(A)_2$; $—(O\leftarrow)N(A)_2$; $—B—R^3—N(A)_2$; $—B—R^3—C(O)N(A)_2$; $—B—R^3—N(\rightarrow O)(A)_2$; $—CO_2^-$; $—SO_3^{-2}$; $—OSO_3^{-2}$; $—O(R^2O)_xCO_2^-$; $—O(R^2O)_xSO_3^{-2}$; and $—O(R^2O)_xOSO_3^{-2}$; with B and $R^3$ as is hereinbefore section D above and $0<x\leqq 4$. Preferably, short-chain surfactants for making complexes have the following general formula:

$$R^4—Y^2$$

wherein $R^1$, $R^3$, B, and $Y^2$ are as hereinbefore and $R^4$ can be chosen from the following: $—(CH_2)_yCH_3$; $—(CH_2)_y$-phenyl or $—(CH_2)_y$-substituted phenyl with $0 \leqq y \leqq 6$ (6)-Block Copolymers Obtained by Copolymerization of Ethylene Oxide and Propylene Oxide Suitable polymers include a copolymer having blocks of terephthalate and polyethylene oxide. More specifically, these polymers are comprised of repeating units of ethylene and/or propylene terephthalate and polyethylene oxide terephthalate at a preferred molar ratio of ethylene terephthalate units to polyethylene oxide terephthalate units of from about 25:75 to about 35:65, said polyethylene oxide terephthalate containing polyethylene oxide blocks having molecular weights of from about 300 to about 2000. The molecular weight of this polymer is in the range of from about 5,000 to about 55,000.

Another preferred polymer is a crystallizable polyester with repeat units of ethylene terephthalate units containing from about 10% to about 15% by weight of ethylene terephthalate units together with from about 10% to about 50% by weight of polyoxyethylene terephthalate units, derived from a polyoxyethylene glycol of average molecular weight of from about 300 to about 6,000, and the molar ratio of ethylene terephthalate units to polyoxyethylene terephthalate units in the crystallizable polymeric compound is between about 2:1 and about 6:1. Examples of this polymer include the commercially available materials Zelcon® 4780 (from DuPont) and Milease® T (from ICI).

Highly preferred polymers have the generic formula:

$$X—(OCH_2CH_2)_n—[O—C(O)—R^1—C(O)—O—R^2)_u—[O—C(O)—R^1—C(O)—O)—(CH_2CH_2O)_n—X^{(1)}$$

in which X can be any suitable capping group, with each X being selected from the group consisting of H, and alkyl or acyl groups containing from about 1 to about 4 carbon atoms, preferably methyl, n is selected for water solubility and generally is from about 6 to about 113, preferably from about 20 to about 50, and u is critical to formulation in a liquid composition having a relatively high ionic strength. There should be very little material in which u is greater than 10. Furthermore, there should be at least about 20%, preferably at least about 40%, of material in which u ranges from about 3 to about 5.

The $R^1$ moieties are essentially 1,4-phenylene moieties. As used herein, the term "the $R^1$ moieties are essentially 1,4-phenylene moieties" refers to compounds where the $R^1$ moieties consist entirely of 1,4-phenylene moieties, or are partially substituted with other arylene or alkarylene moieties, alkylene moieties, alkenylene moieties, or mixtures thereof. Arylene and alkarylene moieties which can be partially substituted for 1,4-phenylene include 1,3-phenylene, 1,2-phenylene, 1,8-naphthylene, 1,4-naphthylene, 2,2-biphenylene, 4,4-biphenylene and mixtures thereof. Alkylene and alkenylene moieties which can be partially substituted include ethylene, 1,2-propylene, 1,4-butylene, 1,5-pentylene, 1,6-hexamethylene, 1,7-heptamethylene, 1,8-octamethylene, 1,4-cyclohexylene, and mixtures thereof. For the $R^1$ moieties, the degree of partial substitution with moieties other than 1,4-phenylene should be such that the desired properties of the compound are not adversely affected to any great extent. Generally, the degree of partial substitution which can be tolerated will depend upon the backbone length of the compound, i.e., longer backbones can have greater partial substitution for 1,4-phenylene moieties. Usually, compounds where the $R^1$ comprise from about 50% to about 100% 1,4-phenylene moieties (from 0 to about 50% moieties other than 1,4-phenylene) are adequate. Preferably, the $R^1$ moieties consist entirely of (i.e., comprise 100%) 1,4-phenylene moieties, i.e., each $R^1$ moiety is 1,4-phenylene.

For the $R^2$ moieties, suitable ethylene or substituted ethylene moieties include ethylene, 1,2-propylene, 1,2-butylene, 1,2-hexylene, 3-methoxy-1,2-propylene and mixtures thereof. Preferably, the $R^2$ moieties are essentially ethylene moieties, 1,2-propylene moieties or mixture thereof. Surprisingly, inclusion of a greater percentage of 1,2-propylene moieties tends to improve the water solubility of the compounds.

Therefore, the use of 1,2-propylene moieties or a similar branched equivalent is desirable for incorporation of any substantial part of the polymer in the liquid fabric softener compositions. Preferably, from about 75% to about 100%, more preferably from about 90% to about 100%, of the $R^2$ moieties are 1,2-propylene moieties.

The value for each n is at least about 6, and preferably is at least about 10. The value for each n usually ranges from about 12 to about 113. Typically, the value for each n is in the range of from about 12 to about 43.

A more complete disclosure of these polymers is contained in European Patent Application 185,427, Gosselink, published Jun. 25, 1986, incorporated herein by reference.

Other preferred copolymers include surfactants, such as the polyoxypropylene/ polyoxyethylene/polyoxypropylene (PO/EO/PO) reverse block polymers. The copolymer can optionally contain propylene oxide in an amount up to about 15% by weight. Other preferred copolymer surfactants can be prepared by the processes described in U.S. Pat. No. 4,223,163, issued Sep. 16, 1980, Builloty, incorporated herein by reference.

Suitable block polyoxyethylene-polyoxypropylene polymeric compounds that meet the requirements described hereinbefore include those based on ethylene glycol, propylene glycol, glycerol, trimethylolpropane and ethylenediamine as initiator reactive hydrogen compound. Certain of the block polymer surfactant compounds designated PLURONIC® and TETRONIC® by the BASF-Wyandotte Corp., Wyandotte, Mich., are suitable in compositions of the invention.

A particularly preferred copolymer contains from about 40% to about 70% of a polyoxypropylene/polyoxyethylene/ polyoxypropylene block polymer blend comprising about 75%, by weight of the blend, of a reverse block copolymer of polyoxyethylene and polyoxypropylene containing 17 moles of ethylene oxide and 44 moles of propylene oxide; and about 25%, by weight of the blend, of a block copolymer of polyoxyethylene and polyoxypropylene initiated with trimethylolpropane and containing 99 moles of propylene oxide and 24 moles of ethylene oxide per mole of trimethylolpropane. Suitable for use as copolymer are those having relatively high hydrophilic-lipophilic balance (HLB).

Other polymers useful herein include the polyethylene glycols having a molecular weight of from about 950 to about 30,000 which can be obtained from the Dow Chemical Company of Midland, Mich. Such compounds for example, have a melting point within the range of from about 30° C. to about 100° C., can be obtained at molecular weights of 1,450, 3,400, 4,500, 6,000, 7,400, 9,500, and 20,000. Such compounds are formed by the polymerization of ethylene glycol with the requisite number of moles of ethylene oxide to provide the desired molecular weight and melting point of the respective polyethylene glycol.

(7)-Alkyl Amide Alkoxylated Nonionic Surfactants

Suitable surfactants have the formula: $R—C(O)—N(R^4)_n—[(R^1O)_x(R^2O)_yR^3]_m$ wherein R is $C_{7-21}$ linear alkyl, $C_{7-21}$ branched alkyl, $C_{7-21}$ linear alkenyl, $C_{7-21}$ branched alkenyl, and mixtures thereof. Preferably R is $C_{8-18}$ linear alkyl or alkenyl. $R^1$ is $—CH_2—CH2-$, $R_2$ is $C_3$–$C_4$ linear alkyl, $C_3$–$C_4$ branched alkyl, and mixtures thereof; preferably $R^2$ is $—CH(CH_3)—CH_2—$. Surfactants which comprise a mixture of $R^1$ and $R^2$ units preferably comprise from about 4 to about 12 $—CH_2—CH_2—$ units in combination with from about 1 to about 4 $—CH(CH_3)—CH_2—$ units. The units may be alternating or grouped together in any combination suitable to the formulator. Preferably the ratio of $R^1$ units to $R^2$ units is from about 4:1 to about 8:1. Preferably an $R^2$ unit (i.e. $—C(CH_3)H—CH_2—$) is attached to the nitrogen atom followed by the balance of the chain comprising from about 4 to 8 $—CH_2—CH_2—$ units.

$R^3$ is hydrogen, $C_1$–$C_4$ linear alkyl, $C_3$–$C_4$ branched alkyl, and mixtures thereof; preferably hydrogen or methyl, more preferably hydrogen.

$R^4$ is hydrogen, $C_1$–$C_4$ linear alkyl, $C_3$–$C_4$ branched alkyl, and mixtures thereof; preferably hydrogen. When the index m is equal to 2 the index n must be equal to 0 and the R4 unit is absent.

The index m is 1 or 2, the index n is 0 or 1, provided that m+n equals 2; preferably m is equal to 1 and n is equal to 1, resulting in one $—[(R^1O)_x(R^2O)_yR^3]$ unit and R4 being present on the nitrogen. The index x is from 0 to about 50, preferably from about 3 to about 25, more preferably from about 3 to about 10. The index y is from 0 to about 10, preferably 0, however when the index y is not equal to 0, y is from about 1 to about 4. Preferably all the alkyleneoxy units are ethyleneoxy units.

Examples of suitable ethoxylated alkyl amide surfactants are Rewopal® $C_6$ from Witco, Amidox® C5 from Stepan, and Ethomid® O/17 and Ethomid® HT/60 from Akzo.; and (8)-Mixtures Thereof Phase Separation Inducing Polymers The compositions of the present invention may optionally contain a low or a relatively high level of polymers, e.g. from 0% up, normally from about 0.05% to about 15%, preferably from about 0.1% to about 10%, and more preferably from about 0.2% to about 5%, by weight of the composition. In the compositions of the present invention, the polymer can help to induce the formation of visually distinct layers. Addition of polymer may lead to the formation of an aqueous bottom layer, while the top layer will consist of a clear/translucent formulation containing the fabric conditioning active in the L3 or sponge phase. The polymers useful in this invention can be linear or branched, in case the polymer is a co-polymer, it can be a random, a block or a grafted block co-polymer. Water soluble polymers (i.e. polymers showing a water solubility above the level at which they are present in the composition) are highly preferred in the present invention. Most preferred are water soluble polymers with a molecular weight above about 2000.

II. Methods of Making the Composition

The compositions of the present invention are formulated by mixing the components in the amounts/ratios described herein using conventional techniques and methods.

III. Methods of Use

The present invention also provides a number of methods and uses of the present compositions.

Foremost, the invention concerns methods for imparting one or more fabric care benefits using the compositions of the present invention. Accordingly, the present invention comprises a method for imparting one or more fabric care benefits to fabrics or garments by first shaking a fabric care composition having at least two visually distinct phases to form a temporary mixture of the composition and delivering a representative dose of the mixture to a laundry solution containing those fabrics or garments. As used herein, "laundry solution" refers to a pre-treatment or pre-soaking solution in which the fabrics are immersed prior to the application of a detergent composition as well as a rinse bath solution that is used following the application of such a detergent. The method is capable of providing a fabric or garment with wrinkle reduction, antibacterial effect, malodor control, color appearance, ultra-violet protection and fabric wear properties among other fabric care benefits. Therefore, it is envisioned that the compositions of the present invention may be used as a pre-treating composition and as a rinse added fabric conditioning composition.

The temporary mixture is formed by manually shaking the composition in a container for less than about 60 seconds, preferably less than about 45 seconds, more preferably less than about 30 seconds, even more preferably less than about 15 seconds and still more preferably les than about 5 seconds. Regardless of the means by which the temporary mixture is formed, the procedure should not require excessive time or energy, or the use of mechanical shaking or mixing means.

As described above, the temporary mixture formed must be sufficiently fluid and uniform to enable the dosing of a representative sample of the mixture. The compositions can be added directly to the rinse bath to provide adequate usage concentration, e.g., at least about 50 ppm and more preferably of from about 100 to about 10,000 ppm of the liquid rinse added fabric softeners of the present invention. Alternatively, the representative dose may be placed in the dispensing drawer or similar dispensing device in an automated washing machine at the beginning of the wash cycle for subsequent release during a rinse cycle. Such devices are well known in the art and include but are not limited to self-contained dispensing devices that are placed in the wash tub such as the DOWNY BALL® available from The Procter & Gamble Company. The compositions of the present invention may also be dispensed directly to the rinse bath solution.

It is also envisioned that the compositions of the present invention will be used in combination with other fabric care products as a part of the consumer's laundry cleaning regimen with the purpose of imparting specific fabric care benefits to fabrics during the laundering procedure. More specifically, the compositions of the present invention may be used in combination with one or more products such as pre-treating or pre-soaking compositions, detergent compositions, and fabric conditioning compositions. As a specific example, it has been found that a pre-treater comprising the color care agents described hereinabove used in combination with the compositions of the present invention provide particularly good color maintenance protection for both new and previously worn clothing during the laundering operation. Descriptions of such a pre-treating composition for use in a regimen with the present compositions are found in WO 00/06680, Ceulam et al., published Feb. 10, 2000; WO 00/08128, Vermote, published Feb. 17, 2000; and WO 36575, Cauwbergh et al., published May 25, 2001 all of which are incorporated by reference herein. As noted, such a regimen is particularly preferred when the pre-treating color care composition is applied to new fabrics and the dual phase composition of the present invention is used regularly in a rinse-added application to maintain the colors of those fabrics.

Methods for imparting one or more fabric care benefits may further comprise the step of instructing a consumer to shake the composition in order to form the temporary mixture, thereby activating the mixture for delivery of a representative dose to the rinse bath solution. This step of instructing the consumer may be accomplished by a set of associated instructions provided with the composition. The set of instructions may be applied to a container for the composition or otherwise included with the packaging provided with the composition. Further, or in the alternative, the instructions may be provided in printed form, recorded on some electronically readable form or orally such as through a live demonstration or presentation. In addition, the set of instructions may include one or more instructions to the consumer informing the consumer how the composition of the present invention may be used in combination with other laundry products such as pre-treating and/or pre-soaking compositions, detergent compositions and fabric conditioning compositions to achieve a specific fabric care benefit that may be desired by the consumer.

The methods of the present invention further include a method for conveying information to a consumer concerning a liquid rinse-added fabric care composition that is capable of delivering multiple fabric care benefits. The method comprises the step of providing a liquid rinse-added fabric care composition that has at least two visually distinct phases. The presence of at least two visually distinct phases suggests to a consumer that the composition is capable of delivering more than one fabric care benefit. When colors are associated with visually distinct phases to represent different fabric care benefits, the viewing of the colored phases will convey more detailed information to the consumer regarding the contents of the composition and the specific fabric care benefits that it will impart to fabrics. Preferably, the composition is provided in a container that enables a consumer to view the visually distinct phases present in the composition before purchasing or using the composition.

IV. Articles of Manufacture

The present invention also provides an article of manufacture comprising a liquid rinse-added fabric care composition that has at least two visually distinct phases that is contained in a container that enables a consumer to view at least two of the visually distinct phases present in the composition. The container may optionally comprise a closure or cap that may be used to dispense the composition.

BRIEF DESCRIPTION OF THE DRAWINGS

Preferably, the container comprises a double walled cap, container and cap shown separately in FIG. 2. More preferably, the container has an insert, which is affixed to the container adjacent the container mouth. The insert provides means for removing excess composition from the inner wall of the cap, thereby reducing the messiness that might otherwise be caused when product drips from the container after consumers have mixed the composition prior to use, poured the composition from the container or cap and when re-closing the container. The insert preferably has curved edge or lip, which may prevent dripping when pouring the product into the cap. Also, the insert preferably has a smooth surface, which may help to control the product flow.

One embodiment of the preferred container is disclosed in FIG. 1.

Figure 1:
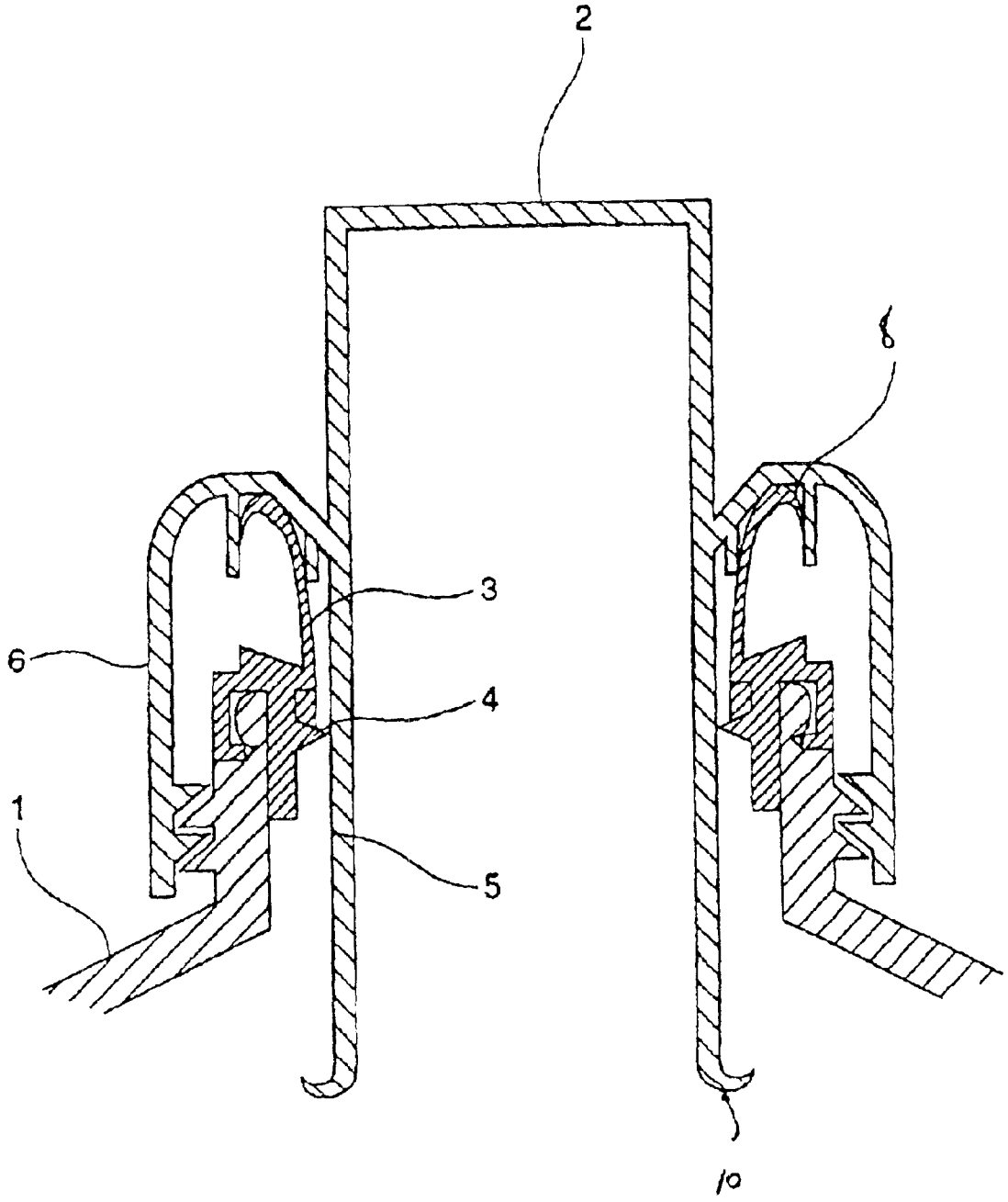
FIG. 1 represents a container with an insert and a cap. Cap 2 has inner wall 5 and outer wall 6. The insert 3 is affixed to the container body 1 adjacent the container opening. Insert 3 has wiper 4 which is concentric with the container opening and extends inwardly therefrom. During the use of cap 2, wiper 4 is in contact with the surface of inner wall 5 removing excess composition that may be present on inner wall 5. Optionally, inner wall 5 may be provided with curved upper lip 10 and container 1 with curved upper lip 8 to promote the even flow of composition from the container and from the cup respectively. Alternatively and as shown in FIG. 1, curved upper lip may be a feature of insert 3. Insert 3 may be manufactured separately to be affixed to conventional containers using known techniques. Alternatively, wiper 4 and when desired optional upper lip 8 may be incorporated directly into the design of container 1.
Figure 2:
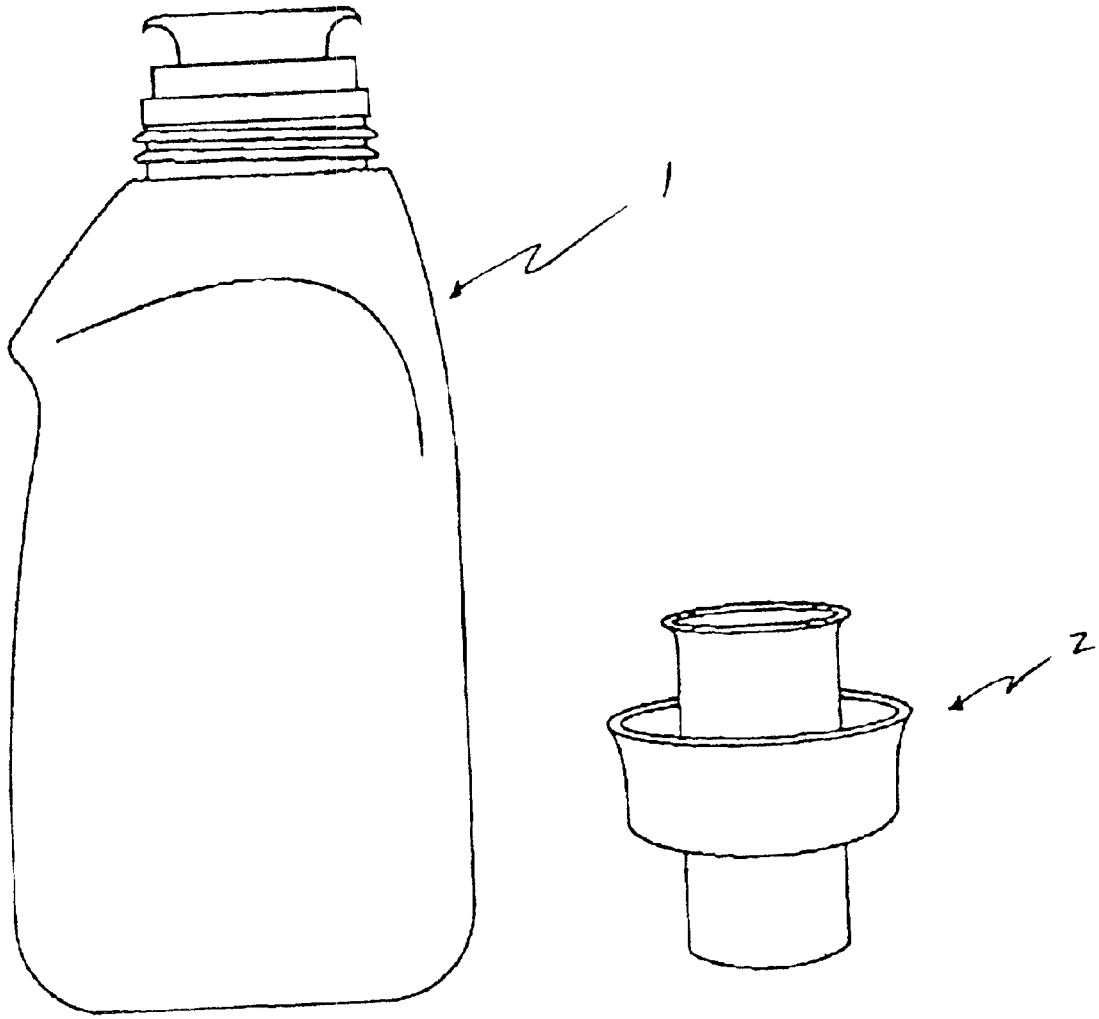

Other suitable packages are described in Japanese Utility Patent Publication H4-7444, published Jan. 23, 1992, Sakai, Japanese Utility Patent Publication 3-102450, published in Oct. 24, 1991, Hamamoto, incorporated herein by reference.

What is claimed is:

1. A liquid rinse-added fabric care composition, the composition characterized by at least two visually distinct phases when the composition is at rest and wherein at least one of the phases contains a fabric care agent, the composition forming a temporary mixture when shaken, the temporary mixture allowing a consumer to dose a representative sample of the composition, the composition re-forming at least two visually distinct phases when at rest; wherein the fabric care agent comprises a fabric softener active, and the composition further comprises a phase separation inducing polymer, wherein the polymer has a molecular weight above about 2000.

2. The composition of claim 1, wherein at least two phases are present in the form of visually distinct layers when the composition is at rest.

3. The composition of claim 1, wherein a first phase is suspended in a second phase when the composition is at rest, the second phase being a continuous phase.

4. The composition of claim 3, wherein the length of the first phase when measured along its shortest axis is larger than about 1 mm.

5. The composition of claim 1, wherein at least two phases are at least about 1% by volume of the composition when the composition is at rest.

6. The composition of claim 1, wherein at least two phases contain more than about 1% of water.

7. The composition of claim 1, wherein at least two phases contain more than about 0.1% of electrolyte.

8. The composition of claim 1, wherein the fabric care agent further comprises at least one chosen from the following: color care agent, perfume, antibacterial agent, malodor control agent, ultraviolet protection agent, anti-abrasion, anti-wear or fabric integrity agent, wrinkle control agent, or a mixture thereof.

9. The composition of claim 1, wherein there are first and second phases and the volumetric ratio of the first phase to the second phase is between about 3:1 and about 1:3.

10. The composition of claim 1, further comprising a dye in at leant one of the phases.

11. The composition of claim 1, wherein the fabric softener active has a transition temperature below about 30° C. in water.

12. The composition of claim 11, further comprising a solvent.

13. The composition of claim 11, further comprising an electrolyte.

14. The composition of claim 11, further comprising a phase modifier.

15. The composition of claim 12, wherein the solvent has a ClogP of from about −2.0 to about 3.

16. The composition of claim 13, wherein the electrolyte is present at a level such that the ratio of fabric softener active to electrolyte is less than about 50:1.

17. The composition of claim 14, wherein the phase modifier is present at a level such that the ratio of fabric softener active to phase modifier is between about 2:1 and about 30:1.

18. The composition of claim 1, wherein the ratio of fabric softener active to polymer is less than about 50:1.

19. The composition of claim 12, wherein the ratio of fabric softener to solvent is between about 2:1 and about 10:1.

20. The composition of claim 11, further comprising a dye.

21. The composition of claim 1, wherein the temporary mixture formed after shaking is sufficiently fluid and uniform to allow the sampling of a representative dose of the composition, said representative dose having a viscosity less than about 10 Pa.sec. when said viscosity is measured within about 1 minute after forming the temporary mixture.

22. The composition of claim 1, wherein the temporary mixture formed after shaking is sufficiently fluid and uniform to allow the sampling of a representative dose of the composition, said representative dose having an amount of active that varies less than about 5% from the average amount of active present in the total volume of the composition when said dose is sampled within 5 seconds after forming the temporary mixture.

23. The composition of claim 1, wherein the temporary mixture formed after shaking is sufficiently fluid and uniform to allow the sampling of a representative dose of the composition, said representative dose having an amount of active that varies less than about 10% from the average value of active present in the total volume of the composition when said active is sampled about 15 seconds after forming the temporary mixture.

24. The composition of claim 1, wherein the temporary mixture formed after shaking will spontaneously form at least two visually distinct phases within about 24 hours when kept at rest.

25. An article of manufacture comprising:

a composition of claim 1; and a container for the composition, said container having means that enables a consumer to view the visually distinct phases of the composition.

26. The article of claim 25, further comprising a set of associated instructions instructing a consumer how to activate the composition by forming the temporary mixture.

27. An article of manufacture comprising:

a composition of claim 1; and a container having a cap and an opening for receiving the cap, said container also having removing means adjacent the opening for removing excess composition from the cap.

28. The article of claim 27, wherein the removing means is an insert affixed to the container that has an inwardly extending wiper.

29. The article of claim 27, wherein the removing means is a wiper inwardly extending from the container walls.

30. The container according to claim 27, wherein the cap is a double-walled cap.

31. A liquid rinse-added fabric care composition, the composition characterized by at least two visually distinct phases when the composition is at rest and wherein at least one of the phases contains a fabric care agent, the composition forming a temporary mixture when shaken, the temporary mixture allowing a consumer to dose a representative sample of the composition, the composition re-forming at least two visually distinct phases when at rest; and wherein the fabric care agent comprises a fabric softener active having a transition temperature below about 30° C. in water; and a solvent having a ClopP of from about −2.0 to about 3; and wherein the composition comprises a phase separation inducing polymer, wherein the polymer has a molecular weight above about 2,000.

* * * * *